US005483937A

United States Patent [19]

Firey

[11] Patent Number: 5,483,937

[45] Date of Patent: Jan. 16, 1996

[54] ACTUATOR FOR ENGINE FUEL INJECTOR SYSTEM

[76] Inventor: Joseph C. Firey, P.O. Box 15514, Seattle, Wash. 98115-0514

[21] Appl. No.: 339,087

[22] Filed: Nov. 14, 1994

[51] Int. Cl.[6] ..... F02D 41/14; F02M 45/00

[52] U.S. Cl. ..... 123/435; 123/446; 123/495; 123/684

[58] Field of Search ..... 123/435, 445, 123/446, 478, 495, 672, 677, 679, 684

[56] References Cited

U.S. PATENT DOCUMENTS 3,851,635 12/1974 Murtin et al. ..... 123/478 X
4,297,982 11/1981 Lakra ..... 123/446 X
4,425,892 1/1984 Firey ..... 123/430
4,508,273 4/1985 Firey ..... 123/533 X
4,633,837 1/1987 Babitzka et al. ..... 123/478

*Primary Examiner*—Tony M. Argenbright

[57] ABSTRACT

The actuator described herein can be used with those gasoline engine fuel injection systems which maintain a constant value of instantaneous fuel to air ratio throughout each intake stoke of the engine. When used with these fuel injection systems the actuators described herein act to maintain a constant overall fuel to air ratio from one engine cycle to the next over a wide range of engine operating conditions.

7 Claims, 7 Drawing Sheets

ACTUATOR FOR ENGINE FUEL INJECTOR SYSTEM

BACKGROUND OF THE INVENTION

1. Field of the Invention

This invention is in the field of fuel injection systems for internal combustion engines, and particularly fuel injection system for four stroke cycle engines which inject the fuel into the engine intake manifold.

2. Description of the Prior Art

Within the past several years the gasoline engine carburetor has been largely replaced with intake manifold gasoline injector systems in many engine applications. Most of these prior art gasoline injector systems inject the fuel at constant pressure and control the fuel quantity by controlling the time duration of injection. An electronic controller, responsive to engine intake air flow rate and engine speed sensors, adjusts times duration of fuel injection so as to maintain the desired overall air to fuel ratio created in the intake manifold. The electronic controller can be additionally responsive to engine exhaust gas composition sensors which provide a feedback control to more closely adjust fuel injection duration, and hence overall air to fuel ratio, for minimum emission of undesirable exhaust gas constituents. This capability of using a feedback control from the exhaust is a principal reason why carburetor fuel systems were replaced with fuel injector systems, since it is difficult to properly introduce feedback control into a carburetor system.

A particular benefit of typical carburetor fuel systems is that the instantaneous rate of fuel flow is roughly proportional to the instantaneous rate of air flow. As a result, during each engine intake stroke, regions of excessively lean air to fuel ratio and other regions of excessively rich air to fuel ratio can be largely avoided and a roughly uniform instantaneous air to fuel ratio is created in each intake mixture charge going into each engine cylinder.

Present gasoline injector systems tend to create both excessively rich air fuel mixture regions and excessively lean air fuel mixture regions since the instantaneous rate of fuel flow is not proportioned to the instantaneous rate of air flow into the engine intake manifold. While fuel injection is taking place an over rich region is created, and, after injection ceases an over lean region is created during each engine intake stroke. The over rich region and the over lean region survive compression, in large part, and their subsequent combustion creates undesirable emission components characteristic of both over lean operation and over rich operation even though the overall air fuel ratio is neither over rich nor over lean.

A principal undesirable exhaust emission from over lean mixtures is oxides of nitrogen, whereas from over rich mixtures carbon monoxide and unburned hydrocarbons are among the undesirable exhaust emissions. Between these over lean mixtures and over rich mixtures a rather narrow "window" of mixture ratios exists where net emissions of both types of undesirable exhaust constituents can be minimized. Yet, even when the overall mixture ratio of an engine lies within this narrow "window," excess emissions may occur if this overall mixture is non uniform and stratified, as when present gasoline injector systems are used which create both over lean regions and over rich regions within each air fuel mixture charge going into each engine cylinder.

It would be very beneficial to have available a gasoline fuel injection system, capable of proportioning instantaneous fuel flow rate to instantaneous air flow rate so that a uniform mixture ratio existed, and lying within the minimum net emissions window, for each air fuel mixture charge going into each engine cylinder over a wide range of engine operating conditions. Yet further reductions of undesirable exhaust emissions could be achieved in this way.

3. Definitions

The devices of this invention are intended to be used with a four stroke cycle internal combustion engine mechanism, comprising various elements as are well known in the prior art of internal combustion engines, of which the following elements connect to or cooperate with the devices of this invention:

A. Pistons operate within cylinders, and are driven from a rotating crankshaft, via a connecting rod, to vary the volume of a variable volume chamber enclosed between the cylinder walls and the piston crown.

B. Intake valves, at least one for each cylinder, connect and disconnect the variable volume chamber to and from an intake air supply manifold.

C. Exhaust valves, at least one for each cylinder, connect and disconnect the variable volume chamber to and from an exhaust gas manifold.

D. These intake and exhaust valves are opened and closed by a valve drive means driven in turn from the engine crankshaft so that each engine cylinder carries out a four stroke cycle which is repeated. This four stroke cycle comprises, in time order: an air intake stroke whenever the piston is moving to increase the volume of the variable volume chamber and the intake valve is open and the exhaust valve is closed; a compression stroke whenever the piston is moving to decrease the volume of the variable volume chamber and both intake and exhaust valves are closed; an expansion stroke whenever the piston is moving to increase the volume of the variable volume chamber and both intake and exhaust valves are closed; an exhaust stroke whenever the piston is moving to decrease the volume of the variable volume chamber and the exhaust valve is open and the intake valve is closed.

E. A fuel supply source supplies fuel to the engine and this fuel is mixed into the intake air in the intake manifold.

F. An ignition means ignites the air fuel mixture at some time during the latter part of the compression stroke or the early part of the expansion stroke, and a combustion process thus intervenes between compression and expansion processes. Electric spark ignition means are commonly used but compression alone can be used to cause compression ignition of the air fuel mixture.

G. In many engine applications a torque control means is used for controlling the torque output via the engine crankshaft averaged during at least one or more of the four stroke cycles. For gasoline fueled internal combustion engines the torque controller is often a throttle valve in the air intake manifold which, by controlling the air density during the intake stroke, controls the mass air flow rate per intake stroke, and thus the air mass quantity available for combustion and thus controls the torque output. An intake air supercharger can be used additionally or alternatively as a means for controlling the air density during the intake stroke. For diesel fueled internal combustion engines, using compression ignition, the torque controller usually functions to control the fuel mass flow rate per intake stroke, and thus the fuel quantity available for combustion.

H. During each intake stroke the instantaneous air mass flow rate varies greatly, being related to the velocity of motion of the piston during intake. Since piston velocity changes from zero at the start and end of the intake stroke to maximum during the middle portion of the intake stroke, instantaneous air mass flow rate correspondingly varies from zero or low at the start and end of the intake stroke to maximum during the middle portion of the intake stroke.

I. The instantaneous fuel mass flow rate is not necessarily related to the piston velocity or the instantaneous air mass flow rate but depends upon the fuel introduction device used. When a carburetor is used to introduce fuel into the air intake manifold it is the instantaneous air flow rate through the carburetor venturi which generates the pressure difference forcing fuel into the intake manifold. As a result a rough correspondence exists between instantaneous air flow rate and instantaneous fuel flow rate when a carburetor is used. When a timed fuel injector is used, at constant fuel nozzle pressure difference, the instantaneous fuel flow rate is essentially constant during injection, the total fuel quantity injected per intake stroke being proportioned to the total air quantity per intake stroke by controlling the duration of fuel injection.

J. The mean value of air fuel ratio during any one engine intake stroke is the mass ratio of the air flow rate per intake stroke to the fuel flow rate per intake stroke. If electric spark ignition is used to initiate the combustion process this mean value of air fuel ratio must be kept within the spark ignition range. Where compression ignition is used to initiate the combustion process this mean value of air fuel ratio can be varied over a wider range than the spark ignition range.

SUMMARY OF THE INVENTION

The actuators of this invention act upon the fuel flow control means of those engine fuel injection systems which function to maintain a constant value of the instantaneous mass ratio of fuel to air, for the mixture being created in the engine intake manifold, throughout each engine intake stroke. The actuators of this invention respond to engine speed, intake air mass per intake stroke, and intake manifold pressure, and act upon the fuel flow control means of the injection system so that the ratio of fuel quantity delivered to each engine cylinder per intake stroke to the air quantity delivered to each engine cylinder per intake stroke remains essentially constant at all engine speeds and loads. In this way not only are different portions of a single cylinder charge of air fuel mixture of the same fuel air ratio but different cylinder charges are also of the same air fuel ratio. This dual uniformity of air fuel ratio can be utilized to minimize undesirable exhaust emissions and improve engine efficiency.

A positive displacement gas compressor, whose speed is a fixed multiple of engine speed, compresses air from the engine intake manifold into a compressed gas receiver. This compressed air flows out of the receiver through a spill orifice and back into the engine intake manifold. The resulting pressure in the compressed gas receiver is proportional to the product of engine speed times air mass quantity delivered to each engine cylinder per engine intake stroke.

A piston and cylinder, with a spring acting on one side of the piston and compressed gas receiver pressure acting on the other side of the piston, acts as a fuel flow control actuator. This actuator functions via a drive bar from the piston and an interconnector means to the fuel flow control means of the engine fuel injection system to control the fuel quantity delivered to each engine cylinder per intake stroke by the fuel injection system. In this way fuel quantity per engine intake stroke is proportioned to air quantity per engine intake stroke.

In one preferred form of this invention a reference pressure acts on the spring side of the actuator piston and this reference pressure is set by a reference pressure adjustment and control means. This reference pressure can be so adjusted that the ratio of fuel to air remains essentially constant over a wide range of engine operating conditions and this is one of the beneficial objects of this invention. Additionally the reference pressure can be adjusted in response to feedback from an engine exhaust gas composition sensor so that the ratio of fuel to air remains within the limits of the low exhaust emissions window and this is another beneficial object of this invention.

In another preferred form of this invention a stratifier means is added to the actuator and acts cyclically upon the fuel flow control means of the engine fuel injection system. This stratifier cyclically varies the fuel flow rate through several cycles during each engine intake stroke and in this way creates a stratified air fuel mixture in the engine intake manifold. Such stratification can be used to suppress the combustion violence and noise caused by occurrence of compression ignition and knock and this is a further beneficial object of this invention. Preferably the stratifier means functions only when combustion violence exceeds a preset value as sensed by a combustion violence sensor.

DESCRIPTION OF THE PREFERRED EMBODIMENTS

Figure 1:
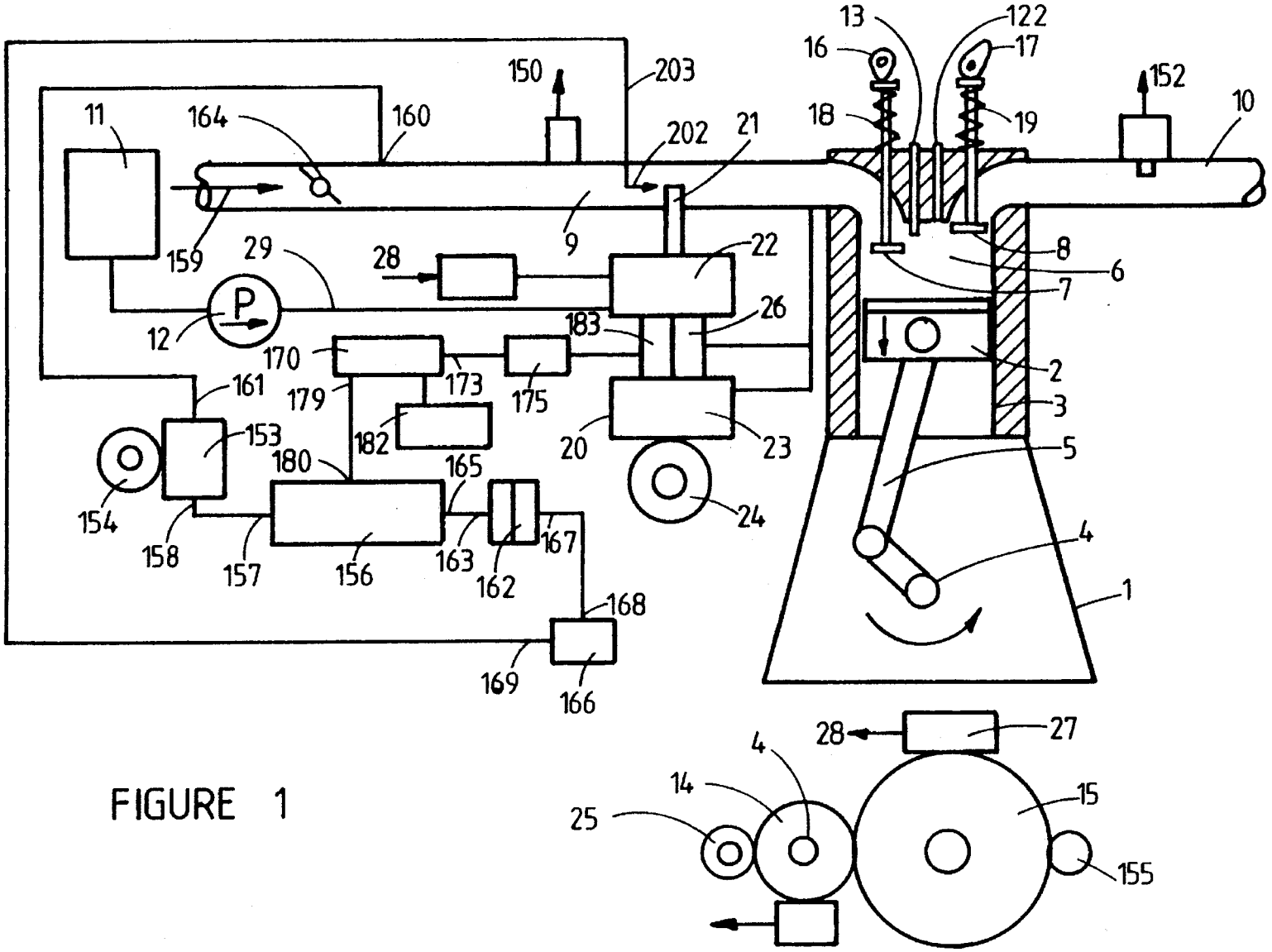
FIG. 1 shows a schematic arrangement of a gasoline fuel injection system for a four-stroke cycle internal combustion engine.

The actuators for engine fuel injection systems of this invention are improvements for use in combination with those four stroke cycle internal combustion engine mechanisms, as described hereinabove, which are equipped with gasoline engine fuel injection systems, as described in detail in my U.S. patent application Ser. No. 08/323,021 filed Oct. 14, 1994 entitled, Gasoline Engine Fuel Injection System, and this material is incorporated herein by reference thereto. Such gasoline engine fuel injection systems are described hereinbelow.

I. Gasoline Engine Fuel Injection System

The gasoline engine fuel injection systems with which this invention is used are improvements for use in combination with a four stroke cycle internal combustion engine mechanism as described hereinabove. All forms of this fuel injection system comprise the following elements, and each piston and cylinder of the internal combustion engine mechanism is served by one such fuel injection system:

1. A gas pressure cycling means is used for cycling the pressure of a gas quantity within a separate variable volume chamber enclosed between a container and a sealable moving element. The gas pressure cycling means also comprises a pressure cycler means for driving the moving element to alternately decrease the variable volume and thus increase the pressure of the gas quantity and then increase the variable volume and thus decrease the pressure of the gas quantity.

The variable volume chamber of the gas pressure cycling means is preferably connected to the engine air supply manifold during the ending of a pressure decrease and the start of the next pressure increase so that the starting pressure of each cycle of pressure increase and decrease equals the engine intake manifold pressure.

2. An inter drive means for driving the pressure cycler drive means from the engine crankshaft is timed so that a single cycle of pressure increase followed by pressure decrease occurs during each engine intake stroke, and the duration of each cycle of pressure increase and decrease is essentially equal to the duration of the intake stroke.
3. A fuel injector means is used for injecting liquid fuel into the engine air supply manifold during each intake stroke. The fuel injector comprises: a nozzle connecting into the engine air supply manifold; a liquid fuel chamber with a liquid pressurizer means, such as a sealed piston or bellows; a nozzle valve and drive means for connecting and disconnecting the nozzle to the liquid fuel chamber; a fuel supply valve and drive means for connecting and disconnecting the liquid fuel chamber to a source of supply of liquid fuel at pressure at least greater than atmospheric pressure.
4. An intake stroke sensor is used to sense both the start and the end of each intake stroke. This sensor output is input to a fuel valve controller which controls the opening and closing of both the nozzle valve and the fuel supply valve of the fuel injector means so that, the nozzle is connected to the liquid fuel chamber only during and throughout each intake stroke, and the fuel supply source is connected to the liquid fuel chamber only when the nozzle is disconnected from the liquid fuel chamber.
5. A pressure transmitter is used to transmit pressure from the variable volume chamber of the gas pressure cycler to the liquid fuel within the liquid fuel chamber of the fuel injector only during and throughout each intake stroke. This pressure transmitter can be for example a simple sealed piston connected directly to the liquid pressurizer of the fuel injector and acted upon by the gas pressure in the variable volume chamber of the gas pressure cycler during each intake stroke. To avoid pressure transmission to the liquid fuel chamber during all engine strokes other than the intake stroke, various means can be used, such as a valve to vent the variable volume chamber of the gas pressure cycler only during these other strokes.

With the above minimum number of elements, and these connected as described, the fuel injection system of this invention operates as follows:

1. During and throughout each engine intake stroke pressure is created in the variable volume chamber of the gas pressure cycler whose moving element is being driven by the pressure cycler drive means and the inter drive means from the engine crankshaft
2. This pressure created in the variable volume chamber of the gas pressure cycler acts via the pressure transmitter to create a pressure on the liquid fuel in the liquid fuel chamber of the fuel injector during and throughout each engine intake stroke.
3. The fuel injector nozzle valve being opened during and throughout each intake stroke by action of the fuel valve controller, liquid fuel is injected into the intake manifold via the fuel injector nozzle under the effect of the pressure created in the liquid fuel chamber. Such injection of liquid fuel into the engine intake manifold occurs only during and throughout the intake stroke since the nozzle valve is closed during all other engine strokes.
4. While the fuel injector nozzle valve of the fuel injector is closed during all engine strokes other than the intake stroke the fuel supply valve is opened by action of the fuel valve controller so that liquid fuel from the supply source can be forced by supply pressure into the liquid fuel chamber of the fuel injector to replace that fuel injected into the engine intake manifold during the preceding intake stroke. No pressure is transmitted to the liquid fuel chamber during all engine strokes other than the intake stroke so that such refueling of the liquid fuel chamber can occur and so that the liquid pressurizer means of the fuel injector and the pressure transmitter can be returned to starting positions.
5. The fuel supply valve of the fuel injector is closed by action of the fuel valve controller so that fuel does not backflow into the supply source during the next intake stroke when the liquid fuel chamber is under the pressure created by the gas pressure cycler acting via the pressure transmitter.

In this way the liquid fuel is injected into the engine intake manifold during and throughout each intake stroke at the same time that intake air is also flowing into the engine cylinder during and throughout the intake stroke. During each intake stroke the instantaneous mass rate of flow of air through the intake manifold and into the engine cylinder is approximately proportional to the instantaneous piston speed, which varies roughly sinusoidally from zero at piston top and bottom dead centers to a maximum near piston mid travel. Also during each intake stroke the instantaneous mass rate of flow of liquid fuel through the fuel injector nozzle and into the intake manifold and thence, in company with the intake air flow, into the engine cylinder is approximately proportional to the square root of the net pressure difference between the liquid fuel chamber and the intake manifold. This net pressure difference is created by action of the gas pressure cycler and the pressure transmitter, and varies during the intake stroke. The instantaneous mass ratio of air to fuel of the air fuel mixtures thusly created in the engine intake manifold can be varied during the intake stroke by varying the pressure transmitted into the liquid fuel chamber from the gas pressure cycler.

In many engine uses it will be preferred that all regions of air fuel mixture be nearly alike in air fuel ratio in order to avoid both over rich regions and over lean regions and thus to avoid the undesirable exhaust emissions generated during the combustion of such regions. The constant mixture ratio cam drive means for driving the moving element of the gas pressure cycler described hereinbelow is one example scheme for achieving uniformity of air fuel ratio in all mixture regions of each total charge of air and fuel going into the engine cylinder during each intake stroke. This constant mixture ratio cam drive means is one of the preferred drive means for driving the moving element of the gas pressure cycler because of this beneficial minimizing of engine exhaust emissions thus made possible. One example arrangement of a gasoline fuel injection system on a four stroke cycle internal combustion engine mechanism is shown schematically in FIG. 1 and comprises the following:

1. A four stroke cycle, single cylinder, engine, 1, is shown with piston, 2, cylinder, 3, crankshaft, 4, connecting rod, 5, variable volume chamber, 6, air intake valve, 7, exhaust valve, 8, air supply manifold, 9, exhaust gas manifold, 10, fuel supply source, 11, and fuel supply pressure pump, 12, ignition means, 13.
2. The valve drive means is shown separated from the engine for clarity and comprises: a drive gear, 14, connected to the crankshaft, 4, and rotated at crankshaft speed, a valve drive gear, 15, rotated at half crankshaft speed by the drive gear, 14, and driving in turn the intake valve cam, 16, and the exhaust valve cam, 17. The intake and exhaust valves are opened by these cams and closed by springs, 18, 19. In FIG. 1 the intake valve is shown open and the exhaust valve is shown closed with the piston descending on the intake stroke and increasing the volume of the variable volume chamber, 6, and intake air is flowing through the intake manifold, 9, and into the variable volume chamber, 6.
3. A gasoline engine fuel injection system, 20, is shown in FIG. 1 and comprises:
   a. A fuel injector nozzle, 21, is injecting liquid fuel into the intake manifold, 9, whenever intake air if flowing into the engine cylinder. This liquid fuel flows from the liquid fuel chamber of the fuel injector means, 22.
   b. A gas pressure cycling means, 23, is driven by a pressure cycler drive means, 24, which is in turn driven at twice crankshaft speed from the inter drive means, 25, driven in turn from the crankshaft drive gear, 14.
   c. A pressure transmitter means, 26, transmits pressure from the gas pressure cycler, 23, to the liquid fuel chamber of the fuel injector, 22.
   d. An intake stroke sensor, 27, is one input to a fuel valve controller means, 28, which controls the opening and closing of a nozzle valve and a fuel supply valve within the fuel injector means, 22, so that the fuel injector nozzle, 21, is connected to the liquid fuel chamber of the fuel injector, 22, only whenever air is flowing into the variable volume chamber, 6, during the intake stroke; the engine fuel supply source is connected via pipe, 29, to the liquid fuel chamber of the fuel injector, 22, only when the nozzle valve is closed.

Figure 2:
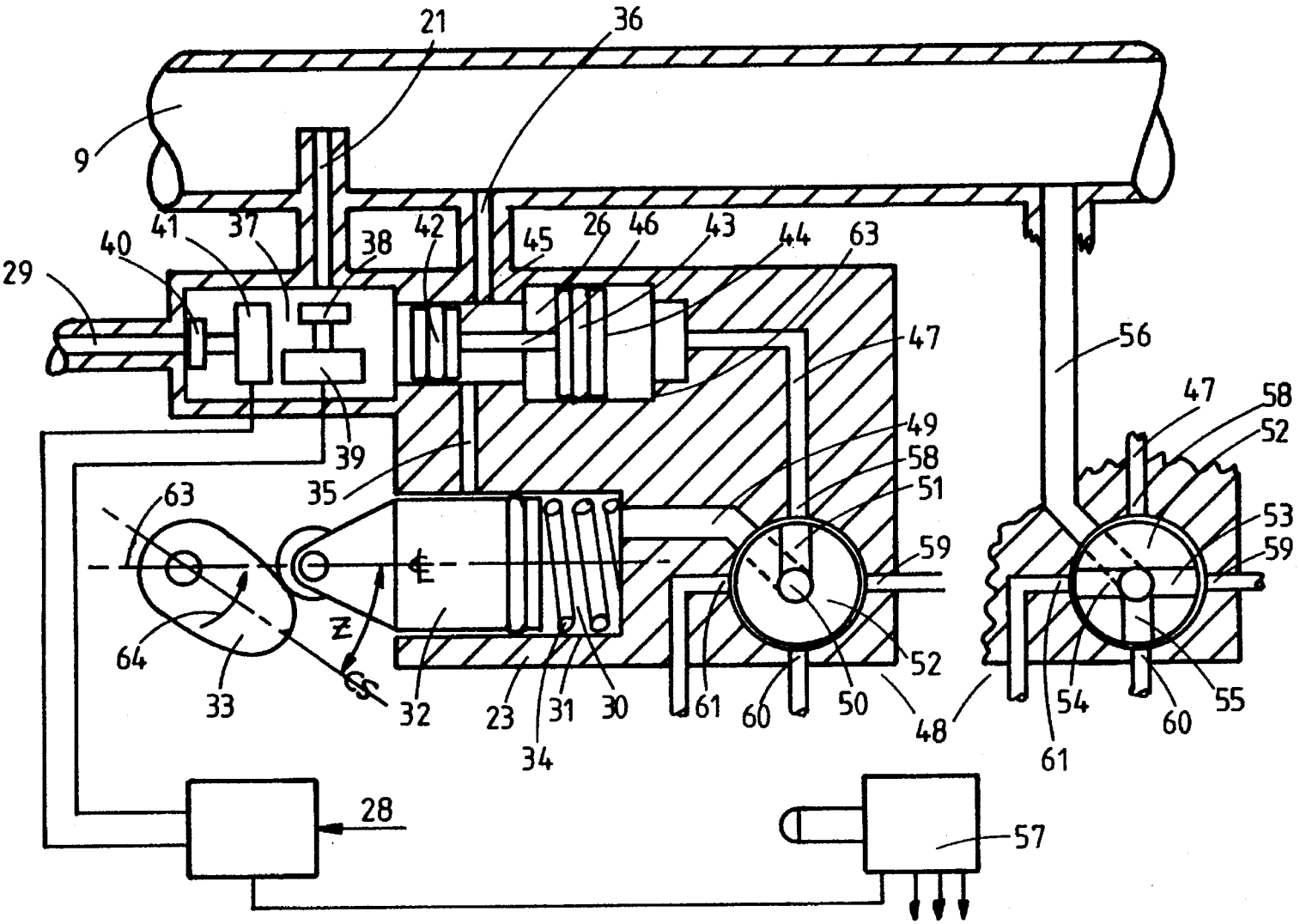
FIG. 2 shows in cross-section the details of the fuel injection system of FIG. 1.

A particular example fuel injection system, 20, is shown in detail in cross section in FIG. 2 and FIG. 1 and comprises the following:

4. The gas pressure cycler, 23, comprises a variable volume chamber, 30, enclosed between the fixed cylinder container, 31, and the moveable sealed piston, 32, which is driven by the pressure cycler drive means cam, 33, and spring, 34, driven in turn from the inter drive means, 25. When the piston, 32, is moved by the cam, 33, to decrease the volume of the variable volume chamber, 30, the gas pressure therein rises, and when the piston, 32, is moved by the spring, 34, and the cam, 33, to increase the volume of the variable volume chamber, 30, the gas pressure therein decreases. In this way a cycle of pressure increase followed by pressure decrease is created at each revolution of the pressure cycler drive cam, 33, and this cycle is timed by the inter drive means, 25, to occur during and throughout each engine intake stroke. The pressure in the variable volume chamber, 30, at the start of each pressure cycle is equalized to that in the engine air intake manifold, 9, via the vent connections, 35, and 36.
5. The fuel injector means for injecting liquid fuel, 22, into the engine intake manifold, 9, comprises a liquid fuel chamber, 37, connectable and disconnectable to the fuel injector nozzle, 21, via the nozzle valve, 38, with nozzle valve drive means, 39, and connectable and disconnectable to the fuel supply source pipe, 29, via the fuel supply valve, 40, with supply valve drive means, 41. The fuel injector nozzle, 21, connects into the engine air intake manifold, 9. A liquid fuel sealed pressurizer piston, 42, applies force from the pressure transmitter, 26, to the liquid fuel within the liquid fuel chamber, 37, and has engine air intake manifold pressure acting on its opposite side, 45, via the vent connection, 36.
6. The pressure transmitter, 26, comprises a sealed gas piston, 43, acted on one side, 44, by the gas quantity in the variable volume chamber, 30, of the gas pressure cycler, 23, and acted on the other side by the pressure in the engine air intake manifold, 9, via the vent connection, 36. The sealed gas piston, 43, is connected directly to the liquid fuel pressurizer piston, 42, by the transmitter bar, 46, in this FIG. 2 form fuel injector so that, the force acting on the gas piston, 43, which is essentially proportional to the net pressure difference between the variable volume chamber, 30, and the air intake manifold, 9, acts also on the liquid fuel pressurizer piston, 42, to create a pressure in the liquid fuel chamber, 37, also essentially proportional to the net pressure difference between the variable volume chamber, 30, and the air intake manifold, 9. The side, 44, of the gas piston, 43, connects to the variable volume chamber, 30, via the pipe, 47, and the selector valve, 48, and the pipe, 49, wherein the pipe, 49, from the variable volume chamber, 30, connects to the common pressure inlet, 50, of the selector valve, 48, and the selector valve pressure port, 51, is shown in FIG. 2 as connecting to the pipe, 47.
7. The fuel valve controller, 28, receives an input signal from the intake stroke sensor, 27, and operates to open and close the nozzle valve, 38, and the fuel supply valve, 40, via their respective drive means, 39 and, 41, so that the nozzle valve, 38, is open only during and throughout the intake stroke, and so that the fuel supply valve, 40, is open only when the nozzle valve, 38, is closed. An electronic controller, 38, and solenoid or solenoid and spring drive means, 39, and, 41, are shown in this FIG. 2 form gasoline engine fuel injector. But a wholly or partially mechanical drive means and controller can alternatively be used with the nozzle valve and fuel supply valve opened and dosed by mechanical drive means, driven in turn via a control drive from the engine crankshaft or camshaft, since the timing of these valves is essentially fixed relative to the engine piston and crankshaft motion.
8. A selector valve, 48, is shown in the FIG. 2 form gasoline engine fuel injector which is suitable for use with four cylinder internal combustion engines, and which comprises:
   a. A rotatable valve port element, 52, with a pressure port, 51, and three interconnected vent ports, 53, 54, 55, has a common pressure inlet, 50, connecting only to the pressure port, 51, and the pressure pipe, 49, from the variable volume chamber, 30, of the gas pressure cycler, 23. The rotatable valve port element, 52, also has a common vent inlet connecting only to the vent ports, 53, 54, 55, and the vent pipe 56, to the engine air intake manifold.

b. A selector valve drive, 57, is shown separated from the rotatable port element, 52, for clarity, and comprises a solenoid, spring, and ratchet type drive mechanism which rotates the rotatable port element, 52, through a 90 degree angle, each time a start of intake stroke signal is received from the fuel valve controller, 28.

c. Four fixed ports, 58, 59, 60, 61, connect separately to each separate pressure transmitter of each separate engine cylinder, the fixed port, 58, connecting to the pressure transmitter, 26, of that one engine cylinder whose air intake manifold, 9, is shown in FIG. 2. The pressure port, 51, of the rotatable port element, 52, is shown in FIG. 2 indexed to the fixed port, 58, for the pressure transmitter, 26, and will remain thusly indexed during and throughout the intake stroke of that engine cylinder whose air intake manifold is, 9. In this way the pressure in the variable volume chamber, 30, is transmitted via pipe, 49, selector valve, 48, pressure port, 51, fixed port, 58, pipe, 47, to the side, 44, of the gas piston, 43, of the pressure transmitter, 26.

d. The selector valve drive means, 57, indexes the pressure port, 51, of the rotatable port element, 52, to the fixed port, 58, at the start of the intake stroke of the thusly connected engine cylinder of air intake manifold, 9, upon receipt of the start of intake stroke signal from the fuel valve controller, 28, of this connected engine cylinder, and this indexing of port, 51, to port, 58, is retained until the selector valve drive means, 57, receives a start of intake stroke signal from that other engine cylinder next in firing order. The fixed ports are arranged in the engine firing order for the four cylinders being served by the single gas pressure cycler, 23.

e. When the pressure port, 51, is thusly connected to the fixed port, 58, the remaining fixed ports, 59, 60, 61, are indexed by the vent ports, 53, 54, 55, and the pressure transmitters for these three other cylinders are then vented to an air intake manifold, so that no pressure is transmitted from the gas pressure cycler, 23, to these other pressure transmitters during the intake stroke for that engine cylinder undergoing an air intake process. This arrangement of pressure and vent ports is repeated in turn in the engine cylinder firing order for each of the four engine cylinders.

f. Electronic and electric drive means, 57, and control means, 28, for the selector valve, 48, are shown in FIG. 2 but wholly or partially mechanical drive and control means can alternatively be used since the timing of the selector valve is essentially fixed relative to the engine piston and crankshaft motion.

9. When a fuel injection system is to be used on a single cylinder engine, the selector valve shown in FIG. 2 can be replaced with a simple pressure and vent valve which opens to vent the pressure transmitter gas pressure side during the engine compression, expansion and exhaust strokes, and closes to transmit pressure from the gas pressure cycler to the gas pressure side of the pressure transmitter only during and throughout the engine air intake stroke.

The example fuel injection system shown in FIG. 2 and FIG. 1 operates as follows:

10. At the start of the intake stoke of the engine cylinder of air intake manifold, 9, the fuel valve controller, 28, having closed the fuel supply valve, 40, opens the nozzle valve, 38, and indexes the gas pressure cycler, 23, to the pressure transmitter, 26, via ports, 51, and 58.

11. At the start of the intake stroke the pressure cycler drive cam, 33, centerline of symmetry, CS, is at an angle, Z, of 180 degrees to the moveable piston centerline, 63, and is being rotated in the direction, 64, by the inter drive means, 25. Thus the variable volume, 30, starts at its maximum value.

12. During an intake stroke the pressure cycler drive cam, 33, will be rotated in the direction, 64, one full turn of 360 degrees during one full intake stroke of 180 degrees, crankshaft rotation. The pressure cycler drive cam, 33, and return spring, 34, thus moves the piston, 32, to first decrease the volume of the variable volume chamber, 30, and then to increase the volume of the variable volume chamber, 30, during each intake stroke. In this way a pressure cycle of pressure increase followed by pressure decrease is created in the variable volume chamber and this cycle of pressure is applied via the pressure transmitter, 26, to the liquid fuel in the liquid fuel chamber, 37.

13. The nozzle valve, 38, being open during and throughout the intake stroke, liquid fuel is forced by the pressure thusly created in the liquid fuel chamber, 37, through the fuel injector nozzle, 21, and into the air mass then flowing through the intake manifold, 9, and into the engine cylinder. The instantaneous mass rate of flow of liquid fuel into the engine air intake manifold 9, during the intake stroke is approximately proportional to the square root of the pressure difference between the liquid fuel chamber, 37, and the air intake manifold, 9, and is approximately inversely proportional to the flow resistance of the fuel injector nozzle. The flow resistance of the fuel injector nozzle is approximately inversely proportional to the flow area thereof. 14. The air fuel ratio of the air fuel mixture being created in the intake manifold, 9, will be the ratio of the instantaneous mass rate of flow of air to the instantaneous mass rate of flow of fuel. The instantaneous mass rate of flow of air is roughly proportional to the instantaneous engine piston speed. An essentially constant air fuel ratio can be achieved in the air fuel mixture by designing the pressure cycler drive cam, 33, so that the resulting instantaneous mass rate of flow of fuel is proportional to the instantaneous mass rate of flow of air throughout the intake stroke. This particular profile of the pressure cycler drive cam is herein referred to as a constant mixture ratio cam profile and this cam profile will be preferred in many engine applications. Other cam profiles can be used, and other types of pressure cycler drive means can be used, such as the crank and connecting rod type of drive means, and these alternative drive means will create non uniform air fuel mixtures in the engine intake manifold.

15. At the end of the intake stroke the fuel valve controller, 28, closes the nozzle valve, 38, and indexes the pressure transmitter, 26, to the vent, 56, and indexes the gas pressure cycler, 23, to the pressure transmitter for that engine cylinder next in the firing order. The fuel supply valve, 40, is then opened and the fuel supply pressure replaces that liquid fuel just previously injected by pushing the pressure transmitter pistons, 42, and 43, back against the stop, 63.

16. The pressure cycler drive cam, 33, continues to rotate but the gas pressure cycler is now similarly acting on the pressure transmitter and liquid fuel injector of the engine cylinder next in the firing order.

17. The cam profile for the constant mixture ratio pressure cycler drive cam is best determined experimentally but an approximate cam profile can be calculated using the following equations for a symmetrical cam:

$$(gcm) = \frac{1}{[CRC-1]}\left[\frac{CRC}{\left\{1+\left[\frac{(CRC)^n-1}{2}\right](1-\text{Cosy})\right\}^{\frac{1}{n}}}-1\right]$$

$$ra = ra1 - (gcm)\,[ra1 - ra0]$$

Wherein:

$$(CRC) = \frac{(VDC+VCLP)}{(VCLP)} = \left[\frac{\text{maximum } pa}{po}\right]^{\frac{1}{n}}$$

(VDC)=Displacement volume of the gas pressure cycler, and (VDC)+VCLO) is the maximum volume of the variable volume thereof;

(VCLO)=Clearance volume of the gas pressure cycler and the minimum volume of the variable volume thereof;

n=Polytropic exponent for the gas compression and expansion processes in the gas pressure cycler variable volume;

(Maximum pa)=Maximum design pressure to be created in the variable volume chamber of the gas pressure cycler;

(po)=Starting pressure in the variable volume chamber of the gas pressure cycler at y=0 degrees, equal to the pressure in the engine air intake manifold at the point where liquid fuel is injected and downstream from the intake air density adjustment means.

(VDC)=(ra1−ra0) (AGP)

(AGP)=Gas pressurizer piston area;

$$\left(\frac{\text{Maximum } pa}{po}\right) =$$

$$(CRC)^n = 1 + \left[\frac{(WA)(3.1417)(RPME)}{(AI)(\sqrt{2g(df)})(\sqrt{po})(\sqrt{J})\,(A/F)_c}\right]^2$$

(WA)=Engine intake air mass flow rate per intake stroke.

(RPME)=Engine crankshaft speed.

(Al)=Flow area of liquid fuel orifice.

(df)=Liquid fuel density.

g=Gravitational constant;

J=

$$\text{Pressure transmitter transmission ratio} = \left(\frac{Pf-po}{pa-po}\right)$$

J=

$$J = \left(\frac{Aa}{Af}\right)$$

For the particular case where liquid piston and gas piston are directly connected as shown in FIG. 2;

(pf)=Pressure in liquid fuel chamber;

(pa)=Pressure in variable volume chamber of gas pressure cycler;

(Aa)=Area of gas piston;

(Af)=Area of liquid piston;

$$\left(\frac{A}{F}\right)_c$$

Figure 3:
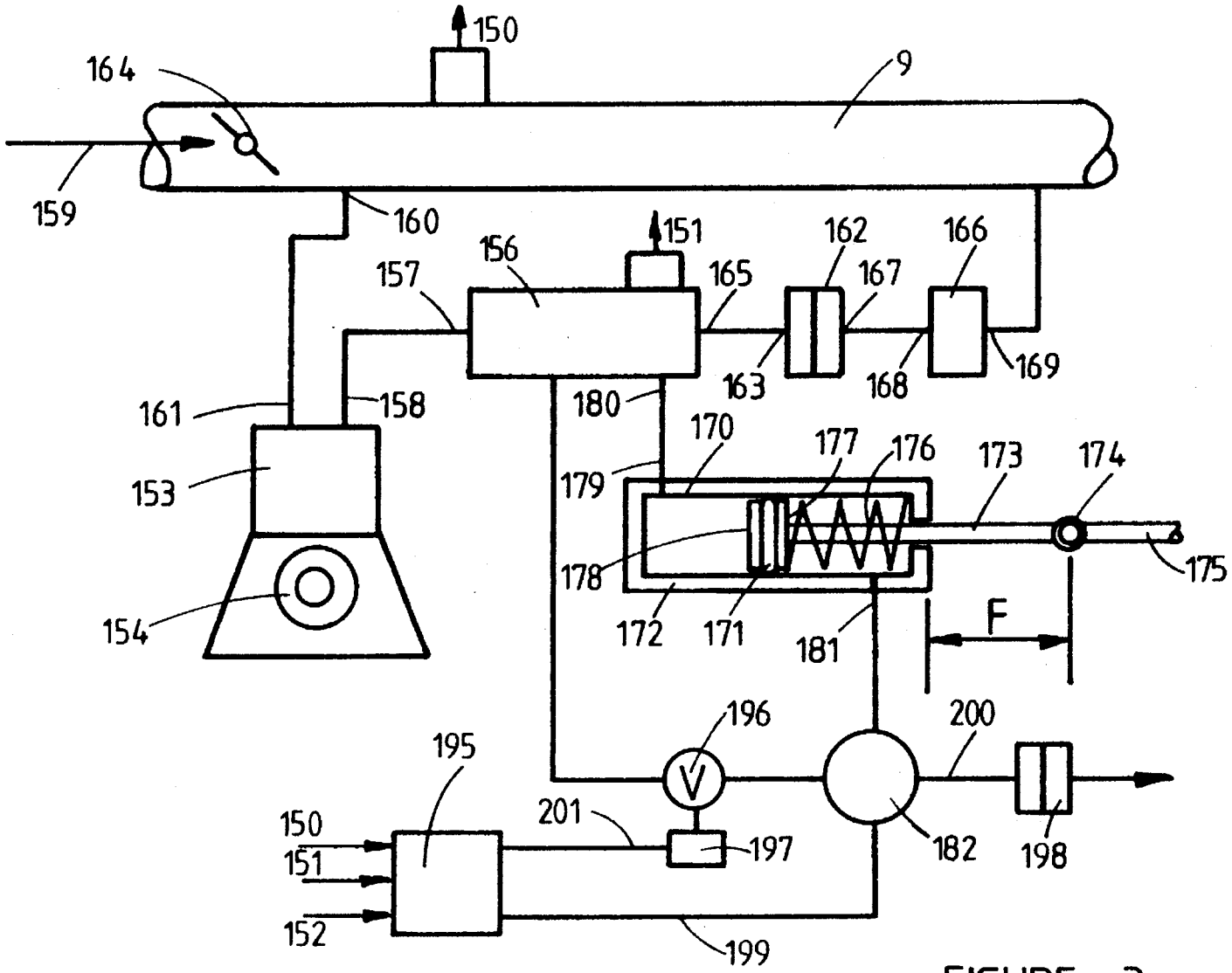
FIGS. 3 and 4 show an interconnector for use with pivoted lever pressure transmitter compensators having movable pivots.

=Desired value of constant instantaneous mass ratio of air to fuel in the engine intake manifold;

Y=angle from the cam centerline of symmetry, CS, to the angular position where the cam radius is equal to ra. Refer to FIG. 3, ra0=Minimum value of cam radius at centerline of symmetry, CS, where Y= 0 degrees;

ra1=Maximum value of cam radius at centerline of symmetry, CS, where Y= 180 degrees;

X=Engine crankshaft angle measured from the piston top dead center position where X=0 degrees;

Any consistent system of units can be used in the foregoing equation.

The pressure cycler drive cam is driven by the inter drive means at twice crankshaft speed, and with the theoretical phase relation that Y=0 degrees when X= 0 degrees and also when X=180 degrees.

By use of the above described fuel injection system, with a constant mixture ratio cam for driving the gas pressure cycler, the net fuel air mixture going into each engine cylinder during each intake stroke can be uniform and devoid of both over lean regions and over rich regions. In this way undesirable exhaust emissions of both oxides of nitrogen and carbon monoxide can be minimized.

II. Compensation for Engine Speed and Torque Changes

The simple form of gasoline engine fuel injector this invention shown in FIG. 2 and described hereinabove is suitable for use on internal combustion engines operated at steady torque and speed, as for example in some kinds of water pumping or electric power generating use. But many internal combustion engines are operated at widely varying torque and speed, as for example in automobiles and trucks. Engine torque output is commonly varied by varying the density of the air entering the engine air intake manifold, 9, as by use of a throttle, 164, and by use of an intake air supercharger, in order to vary the mass rate of air flow per intake stroke. But the mass rate of liquid fuel flow per intake stroke is not correspondingly varied when intake air density is thusly varied for the FIG. 2 form of fuel injector. Thus the mean value of air fuel ratio for each intake stroke, which is the ratio of mass rate of air flow per intake stroke to mass rate of flow of fuel per intake stroke, will become fuel leaner as intake air density is increased and will become fuel richer as intake air density is decreased with this FIG. 2 form of gasoline engine fuel injector.

At a particular intake air density the mass rate of air flow per intake stroke will remain roughly constant over a rather wide range of engine speeds. But the mass rate of flow of liquid fuel per intake stroke decreases as engine speed increases, for the FIG. 2 form of fuel injector, since the time rate of instantaneous liquid fuel flow is essentially constant and the time duration of the intake stroke and hence the time duration for liquid fuel flow decreases as speed increases. Thus the mean value of air fuel ratio for each intake stroke will become leaner as engine speed increases and will become richer as engine speed decreases with this FIG. 2 form of fuel injector. Modified pressure transmitter means or modified fuel injector means can be used together with the actuators of this invention to achieve essentially constant values of mean air fuel ratio per intake stroke with widely varying engine torque and speed as described hereinbelow.

III. Pivoted Lever Pressure Transmitter Compensator

Figure 4:
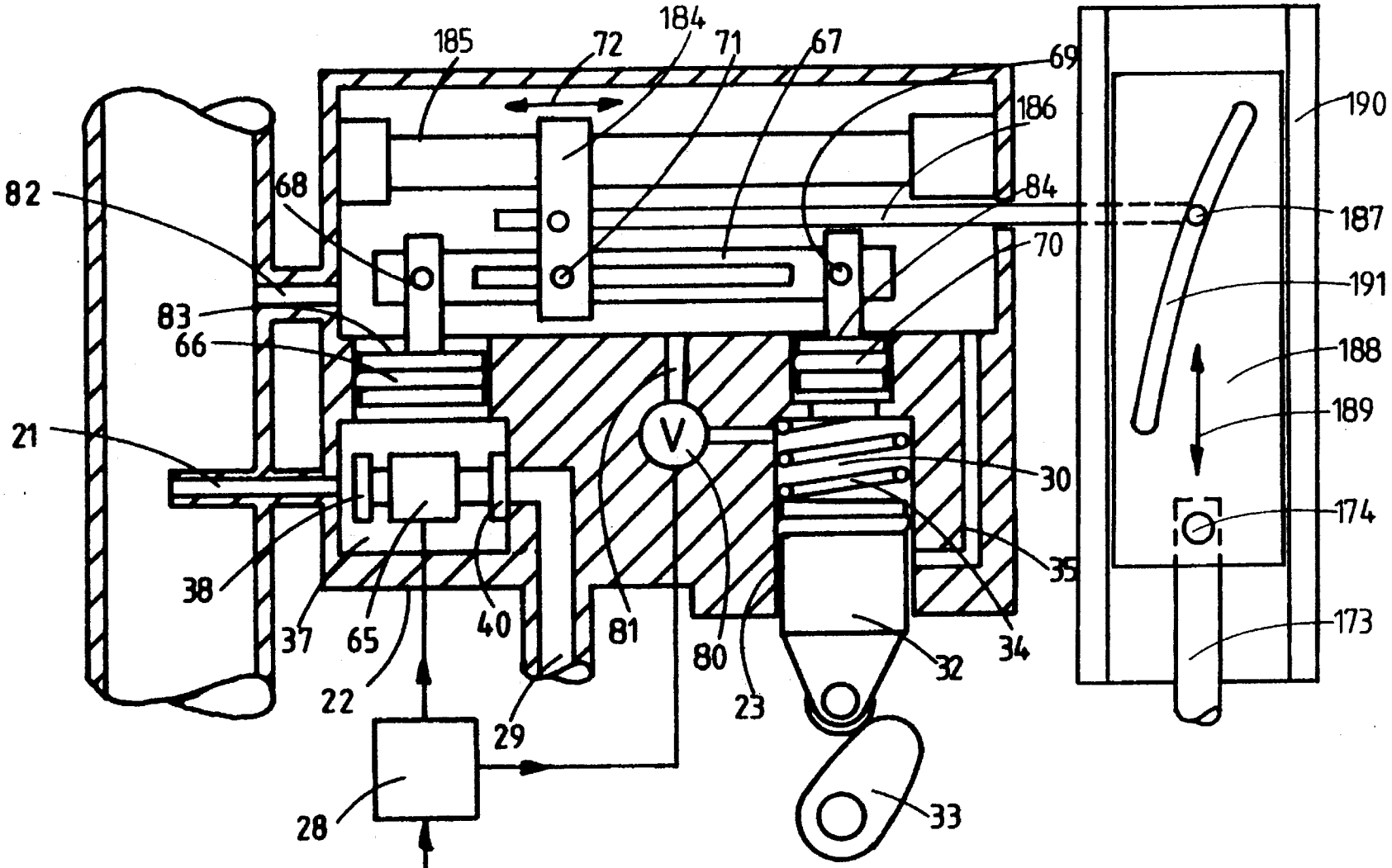

A particular example modified form of pressure transmitter is shown in cross section in FIG. 4 and FIG. 1, suitable for use on internal combustion engines operated over a wide range of speed and torque output, and comprises:

1. The gas pressure cycler, 23, comprising; variable volume chamber, 30, piston, 32, pressure cycler drive cam, 33 and return spring, 34, vent connection, 35, is similar to that of FIG. 2 and operates similarly as described hereinabove.
2. The fuel injector 22, comprising liquid fuel chamber, 37, injector nozzle, 21, nozzle valve, 38, fuel supply valve, 40, is also similar to that of FIG. 2 and operates similarly as described hereinabove. A combined drive means, 65, for driving both the nozzle valve, 38, and the fuel supply valve, 40, is shown in FIG. 4 and can be a single solenoid driver which opens the nozzle valve when closing the fuel supply valve and vice versa.
3. The liquid fuel pressurizer liquid piston, 66, is connected to the end, 68, of a pivoted lever, 67, whose opposite end, 69, is connected to the pressure transmitter gas piston, 70, so that pressure created in the variable volume chamber, 30, of the gas pressure cycler, 23, is transmitted to the liquid fuel in the liquid fuel chamber, 37. The pivoted lever, 67, is pivoted about the pivot, 71, so that the force transmitted from the pressure transmitter piston, 70, to the liquid fuel pressurizer piston, 66, can be adjusted by moving the pivot, 71, in the directions, 72, relative to the ends, 69, and 68, of the lever, 67, where the gas piston, 70, and the liquid piston, 66, respectively connect to the lever, 67. When the pivot, 71, is moved toward the liquid piston, 66, the net force transmitted to the liquid fuel in the liquid fuel chamber, 37, is increased relative to the net force acting on the gas piston, 70, the reverse effect occurring when the pivot, 71, is moved toward the gas piston, 70.

In this way the ratio of net liquid pressure on the liquid fuel in the liquid fuel chamber, 37, to the net gas pressure on the gas piston, 70, can be adjusted by varying the position of the pivot, 71, relative to the liquid piston, 66, and the gas piston, 70. Also in this way the instantaneous mass rates of flow of liquid fuel can be increased by moving the pivot toward the liquid piston, 66, and away from the gas piston, 70, and vice versa. When the instantaneous mass rates of flow of liquid fuel are thusly increased or decreased the mass rate of fuel flow per intake stroke is also correspondingly increased or decreased and thus the mean value of air fuel ratio for each intake stroke can be adjusted by adjusting the position of the pivot, 71, relative to the liquid piston 66, and the gas piston, 70.

4. For an essentially constant mean value of air fuel ratio over a range of engine speeds and torque outputs the proper relation between pivot position and intake air mass flow rate per intake stroke, engine speed, and intake manifold pressure is best determined experimentally. The following approximate equation for the FIG. 4 form gasoline engine fuel injector can be used when a constant mixture cam is used in the gas pressure cycler drive means:

$$\frac{(RPME)(Wa)}{\sqrt{po}} \quad \frac{1}{\sqrt{J}} = a\ \text{constant} = (PS) =$$

-continued $$\left(\frac{A}{F}\right)_c \frac{(Al)(\sqrt{2g(df)})(\sqrt{(CRC)^n - 1})}{(3.1417)}$$

$$J = \left(\frac{pf - po}{pa - po}\right)$$

For the pivoted lever pressure transmitter:

$$J = \frac{(Aa)(la)}{(Af)(lf)}$$

And the value of J is adjusted by the pivot controller so that the value of (PS) remains essentially constant.

Wherein:

(If)=Distance from pivot, 71, to the end, 68, where the liquid piston, 66, connects to the lever, 67;

(la)=Distance from pivot, 71, to the end, 69, where the gas piston, 70, connects to the lever, 67;

Any consistent system of units can be used in the foregoing equations.

5. When this pivoted lever pressure transmitter compensator is used each fuel injector, 22, and gas pressure cycler, 23, can serve but one engine cylinder, as shown in FIG. 4 for example.

IV. Variable Fuel Orifice Area Compensator

Figure 5:
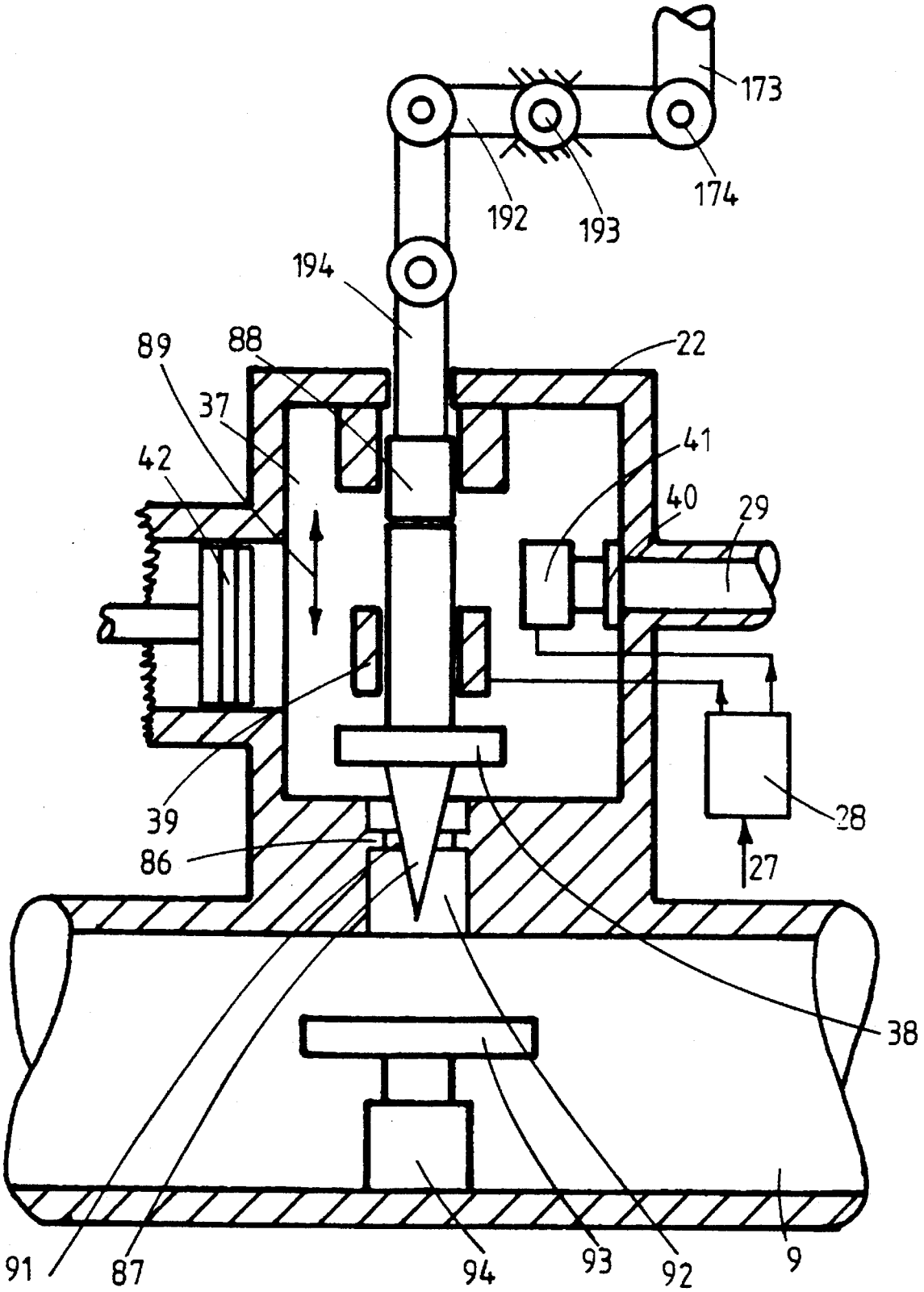
FIG. 5 shows a modified form of fuel injector.

A particular example modified form of fuel injector is shown in FIG. 5 and FIG. 1, which can be used instead of the modified pivoted lever pressure transmitter of FIG. 4 for internal combustion engines operated over a wide range of speed and torque output, and comprises:

1. The gas pressure cycler can be similar in construction and operation to that of FIG. 2 and is not shown in FIG. 5.
2. The modified fuel injector, 22, comprising liquid fuel chamber, 37, fuel supply valve, 40, with drive means, 41, nozzle valve, 38, with drive means, 39, liquid fuel pressurizer liquid piston, 42, is similar to that of FIG. 2 except as follows.
3. The injector nozzle, 92, comprises a fixed orifice, 86, within which a moveable tapered stem, 87, operates and this stem is fastened to the nozzle valve, 38. The tapered stem and nozzle valve are opened by the nozzle valve drive means, 39, against an adjustable stop, 88, during and throughout each engine intake stroke.
4. When the stop, 88, is moved away from the nozzle, 92 the tapered stem, 87, opens a larger annular liquid fuel flow area, 91, when opened against the stop, 88, and the instantaneous mass flow rates of fuel are increased. When the stop, 88, is moved toward the nozzle, 92, the tapered stem, 87, opens a smaller annular liquid fuel flow area, 91, when opened against the stop, 88, and the instantaneous mass flow rates of fuel are decreased. This adjustable stop and tapered nozzle valve stem with orifice scheme is an example of an area means for varying the area of the fuel injector nozzle through which liquid fuel flows.
5. For an essentially constant mean value of air fuel ratio over a range of engine speeds and torque outputs the relation between liquid fuel flow area, 91, can be approximated by the following equation for the FIG. 5 form of fuel injector when a constant mixture cam is used in the gas pressure cycler drive means:

$$\frac{(RPME)(WA)}{(Al)(\sqrt{po})} = FS = \left(\frac{A}{F}\right)_c \frac{(\sqrt{2g(df)})(\sqrt{J})(\sqrt{(CRC)^n - 1})}{(3.1417)}$$

Wherein (Al) is the annular liquid fuel flow area, 91.

7. When this variable fuel orifice area compensator is used alone the gas pressure cycler, 23, can be used separately from the fuel injector, 22, to serve up to four engine cylinders, as shown in FIG. 2 for example.

V. Adjustment of fuel Quantity Delivered Per Engine Intake Stroke

The above described pivoted lever pressure transmitter permits adjustment of fuel quantity delivered into each engine intake manifold per intake stroke by adjusting the pressure difference between the liquid fuel chamber and the engine intake manifold. The above described variable fuel orifice area permits adjustment of fuel quantity delivered into each engine intake manifold per intake stroke by adjusting the fuel flow area of the fuel injector nozzle. Both of these fuel flow control means, whether used alone or in combination, are means for controlling the fuel quantity delivered into each engine intake manifold, and thence into each connected engine cylinder, per engine intake stroke by control of the integrated product of fuel flow area of the fuel injector nozzle multiplied by the square root of the pressure difference between the liquid fuel chamber and the engine intake manifold, this product being integrated over the time duration of one engine intake stroke. The actuators of this invention respond to engine speed, intake air mass per intake stroke and intake manifold pressure, and act upon this fuel flow control means of these gasoline engine fuel injectors so that the ratio of fuel quantity delivered per intake stroke to the air quantity delivered per intake stroke preferably remains essentially constant over a wide range of engine speeds and loads and this is a principal beneficial object of this invention.

VI. Engine Fuel Injector System Actuator

The actuators of this invention comprise the following elements as shown, for example, schematically in FIG. 1 and FIG. 3:

1. A positive displacement air compressor, 153, of fixed displacement is driven at a fixed multiple of engine crankshaft speed by the drive means, 154, and 155.
2. A compressed gas reservoir, 156, receives compressed air via its inlet, 157, from the compressed gas outlet, 158, of the compressor, 153.
3. The compressor, 153, compresses air from the engine intake manifold, 9, from a point therein, 160, downstream in the intake air flow direction, 159, from the means for adjusting intake manifold air density, 164, via the gas inlet, 161, of the compressor, 153. In this FIG. 1 example the engine intake manifold, 9, is thus a source of the gas to be compressed by the compressor, 153.
4. A spill orifice, 162, of fixed minimum flow area, connects via its inlet, 163, to one reservoir outlet, 165, and discharges compressed air out of the reservoir, 153, into the spilled gas collector, 166, via the orifice outlet, 167, and the collector inlet, 168.
5. The outlet, 169, of the spilled gas collector, 166, connects back into the engine intake manifold, 9. In this way air is compressed from the engine intake manifold, 9, by the compressor, 153, into the reservoir, 156, and is discharged from the reservoir via the spill orifice, 162, and returned to the intake manifold via the collector, 166. By a suitable selection of compressor displacement, compressor speed ratio to engine speed and spill orifice minimum flow area, the resulting air pressure in the reservoir, 156, can vary essentially linearly with the product of engine revolutions per minute, RPM, and the air mass quantity delivered into each engine cylinder per engine intake stroke.

This preferred compressed air pressure in the reservoir, 156, is to be at least twice the pressure prevailing in the intake manifold, 9, so that sonic air velocity exists in the spill orifice.

6. The fuel flow control actuator, 170, comprises: a piston, 171, sealably operative within a fixed actuator cylinder, 172, and connecting to a fuel flow control drive bar, 173, whose drive end, 174, connects to an interconnector means, 175; a compression spring, 176, acts on one side, 177, of the piston, 171. The other, anti spring side, 178, of the piston, 171, is connected via the pressure connection, 179, to another reservoir outlet, 180, and thus reservoir air pressure acts on the anti spring side, 178, of the piston, 171. The spring side, 177, of the piston, 171, is connected, via the connection, 181, to a source of gas, 182, at a first reference pressure. This first reference pressure is less than the pressure in the compressed gas reservoir, 156, and greater than the pressure in the engine intake manifold, 9, The piston, 171, together with the drive bar, 173, and drive end, 174, is thus moved against the spring, 176, in linear proportion to the difference between the air pressure in the reservoir, 156, and the reference pressure in the source, 182, and thus the distance, F, between the drive end, 174, and the fixed cylinder, 172, is also linearly proportional to this pressure difference.
7. Various kinds of first reference pressure sources can be used, such as: the atmosphere; a tank whose pressure is set by a hand regulator connecting to compressed gas in a cylinder; a reference pressure adjustment means for adjusting and controlling the first reference pressure automatically in response to intake manifold pressure and compressed gas reservoir pressure as will be described hereinbelow.
8. The fuel flow control means, 183, for controlling the fuel quantity per engine intake stroke, delivered into each engine intake manifold is connected to the drive end, 174, of the actuator drive bar, 173, by the interconnector means, 175. The interconnector means, 175, functions to transform the adjustment motions of the drive bar, 173, into adjustment motion of the fuel flow control means, 183, so that, the fuel quantity delivered to each engine cylinder per intake stroke increases as the air quantity delivered to each engine cylinder per intake stroke increases and decreases as said air quantity decreases. An interconnector means suitable for use with a fuel flow control means using an adjustable pivot pivoted lever pressure transmitter will differ from an interconnector means suitable for use with a fuel flow control means using a variable fuel orifice area adjustment means as will be described hereinbelow. Preferably the interconnector means, 175, adjusts the ratio of actuator bar adjustment motion to the fuel flow control means adjustment motion so that the ratio of fuel quantity delivered per intake stroke to the air quantity delivered per intake stroke remains essentially constant over a wide range of engine speeds and loads. This preferred result can be achieved by compensation of the drive bar adjustment motion by addition of first reference pressure adjustment and control means as described hereinbelow.

9. Various types of positive and fixed displacement air compressor, 153, can be used for the purpose of this invention, such as: piston, cylinder, and crank compressors; rotary vane compressors; diaphragm and crank or cam compressors; etc.

10. Various types of fuel flow control actuator, 170, can be used for the purposes of this invention, such as: piston, cylinder, and spring actuators; bellows, spring and container actuators; diaphragm, spring and chamber actuators; etc.

The example form of this invention shown in FIG. 1 and FIG. 3 and described hereinabove operates as follows when the engine, 1, if running:

1. The air flow caused by the compressor, 153, through the reservoir, 156, and the spill orifice, 162, creates a pressure in the reservoir, 156, which is linearly proportional to the product of engine RPM times the air mass delivered per intake stroke, and this pressure acts on the antispring side, 178, of the actuator piston, 171:

(PAC)=(KP)(RPME)Wa)(evc)

Wherein:

(PAC)=Absolute pressure created in the reservoir, 156;

(RPME)=Engine revolutions per minute;

(Wa)=Air mass quantity per engine intake stroke:

(evc)=Volumetric efficiency of the air compressor, 153;

(KP)=A constant whose value varies inversely with engine valumetric efficiency as described hereinafter;

2. First reference pressure acts on the spring side, 177, of the actuator piston, 171, and hence the distance, F, between the drive end, 174, of the actuator drive bar, 173, and the fixed actuator cylinder, 172, varies linearly with the product of engine RPM times air mass quantity per intake stroke:

$$(F-FO)=(PAC-PR)\frac{(AC)}{(KS)}$$

Wherein:

(PR)=Absolute first reference pressure in the source, 182;

(AC)=Effective area of the piston, 171;

(KS)=Spring constant of the spring, 176, force per unit deflection;

(FO)=the distance, F, when PAC=PR;

Hence:

$$(Wa)(RPME)=\frac{(F-FO)\left(\frac{KS}{AC}\right)+(PR)}{(KP)(evc)}$$

3. The gasoline fuel injector system used with this invention requires that the product of engine RPM times air mass quantity per intake stroke is to vary linearly with the product of, fuel orifice area times the square root of absolute engine intake manifold pressure times the square root of the pressure transmitter transmission ratio, if fuel to air ratio is to remain essentially constant over a wide range of engine speeds and loads, as described hereinabove:

$$(RPME)(Wa)=\left(\frac{A}{F}\right]_c(Al)(\sqrt{Po})(\sqrt{J})(KZ)$$

Wherein:

$$kz=\frac{(\sqrt{2g(df)})(\sqrt{(CRC)^n-1})}{3.1417}=a\text{ constant}$$

Hence:

$$(Al)(\sqrt{Po})(\sqrt{J})=\frac{\left[(F-FO)\left(\frac{KS}{AC}\right)+(PR)\right]}{(KP)(evc)(KZ)\left(\frac{A}{F}\right)_c}$$

This relation tells us how the interconnector, 175, is to transform actuator drive bar adjustment motion, (F-FO), into an adjustment of either the flow area of the liquid fuel orifice, (Al), or the pressure transmitter transmission ratio, (J), of the gasoline fuel injector system.

4. For a relatively simple case of an engine operated at essentially constant intake manifold pressure, (Po), and using a fixed first reference pressure, (PR), a constant air fuel ratio can be obtained by increasing (Al) linearly with (F-FO) for fuel injection systems using variable fuel orifice area compensators. Alternatively a constant air fuel ratio can be obtained by increasing ($\sqrt{J}$) linearly with (F-FO) for fuel injection systems using pivoted lever pressure transmitter compensators. The interconnector, 175, connects the actuator drive bar drive end, 174, to the compensator of the fuel injection system to achieve these linear adjustments of either (Al) or ($\sqrt{J}$) as will be described hereinafter.

5. Very few engines operate at constant intake manifold pressure, (Po), and to the extent that intake manifold pressure varies these engines will experience a variation of air fuel ratio if a constant first reference pressure, (PR), is used. Nevertheless, when engine air mass per intake stroke increases liquid fuel quantity per intake stroke will also increase even if the ratio of these quantities may vary with intake manifold pressure. For a preferred form of this actuator invention the first reference pressure, (PR), is adjusted as intake manifold pressure, (PO), varies in order to achieve an essentially constant air fuel ratio over a wide range of engine speeds and loads, as described hereinafter, and these are among the beneficial objects of this invention.

VI. Interconnector Means

An example interconnector means of this invention suitable for use with gasoline fuel injector systems using pivoted lever pressure transmitter compensators with moveable pivots is shown in FIG. 4 and FIG. 3, and comprises:

1. The pivot holder, 184, is moveable in the direction, 72, along the guide bar, 185, by the cam bar, 186, with captured cam follower, 187, linked to the cam slot, 191, of the linear cam, 188.

2. The linear cam, 188, is moveable in the direction, 189, along the guide slot, 190, by the drive end, 174, of the actuator drive bar, 173.

3. The cam slot, 191, is arranged so that the pivot, 71, is moved toward the liquid fuel piston, 66, connection, 68, when drive bar, 173, is moved by the actuator, 170, to increase distance, F, between the drive end, 174, and the actuator cylinder, 172; and so that the pivot, 71, is moved toward the gas piston, 70, connection, 69, when drive bar, 173, is moved by the actuator, 170, to decrease distance, F.

4. The shape of the cam slot is defined by the following equation for those preferred forms of this invention which seek to maintain a constant air fuel ratio over a wide range of engine speeds and loads:

$$lf = \frac{(la + lf)}{1 + (KJ)\,(F - FO)^2}$$

Wherein:

$$(KJ) = \frac{(KS)^2(Af)}{(KL)^2(KR)^2(evc)^2(AC)^2(Aa)}$$

$$(KL) = (KZ)(Al)\left(\frac{A}{F}\right)_c$$

(KR)=A constant whose value depends upon the reference pressure source used as described hereinafter;

An example interconnector means of this invention suitable for use with gasoline fuel injector systems using variable fuel orifice area compensators is shown in FIG. 5 and FIG. 3 and comprises:

1. The interconnector bar, 192, pivoted about the fixed pivot, 193, connects the drive end, 174, of the actuator drive bar, 173, to the adjustable stop, 88, via the sealed link, 194.
2. When the distance, F, between the drive end, 174, of the actuator drive bar, 173, and the fixed cylinder, 172, is increased by the actuator, 170, the adjustable stop, 88, is retracted so that: when the nozzle valve, 38, is opened during the intake stroke, against the stop, 88, the tapered nozzle stem, 87, opens a larger liquid fuel orifice flow area, 91; and so that a smaller liquid fuel orifice flow area, 91, is opened when the distance, F, is decreased.
3. The shape of the tapered nozzle stem, 87, is defined by the following equation for those preferred forms of this invention which seek to maintain a constant air fuel ratio over a wide range of engine speeds and loads:

$$(DP) = \sqrt{(DO)^2 - \frac{4(KH)}{3.1417}\,(F - FO)}$$

Wherein:

(DP)=Tapered nozzle stem diameter at the fixed orifice, 86, when the drive end to fixed cylinder distance is F;

(DO)=Diameter of the fixed orifice, 86;

$$(KH) = \frac{(KS)}{(KF)(KR)(AC)(evc)}$$

$$(KF) = (KZ)(\sqrt{J})\left(\frac{A}{F}\right)c$$

VII. Reference Pressure Compensation

An example adjustment and control means for generating a first reference pressure source, responsive to both intake manifold absolute pressure (PO) and compressed gas reservoir pressure, (PAC), and capable of adjusting the first reference pressure, (PR), so that the ratio of fuel quantity delivered per intake stroke to the air quantity delivered per intake stroke remains essentially constant over a wide range of engine speeds and loads, is shown schematically in FIG. 3 and comprises:

1. An intake manifold pressure sensor, 150, for sensing intake manifold pressure and whose output is an input to the controller, 195.
2. A compressed gas reservoir pressure sensor, 151, for sensing reservoir pressure and whose output is another input to the controller, 195.
3. A cycling valve, 196, with cycling drive means, 197, which admits compressed air from the compressed gas reservoir, 156, into the first reference pressure source tank, 182.
4. The first reference pressure source, 182, connects to the spring side of the actuator, 170, via connection 181, and to the controller, 195, via connection, 199, and to a slow bleed orifice, 198, via connection, 200.
5. The slow bleed orifice, 198, spills air out of the first reference pressure source, 182, either to atmosphere or back into the engine intake manifold, 9.
6. The cycling valve drive means, 197, opens and closes the cycling valve, 96, constantly at a cycling frequency preferably greater than engine rotational frequency and with the ratio of valve open time to valve closed time being adjustable by the controller, 195, via connection, 201.
7. The preferably electronic controller, 195, senses intake manifold pressure, 150, and compressed gas reservoir pressure, 151, and calculates that valve of reference pressure, (PRC), which will create an essentially constant air fuel ratio by the following equation:

$$(PRC) = (PAC)\left[1 - \frac{K8}{\sqrt{po}}\right]$$

Wherein:

$$(K8) = \frac{(KD)}{(KP)}$$

$$(KP) = \frac{(KR)}{(KV)}\;\frac{2\sqrt{TA}}{(eve)(0.53)(AO)(CD)(60)}$$

$$(KR) = \text{Ratio}\left(\frac{\text{Air Compressor revolutions per min.}}{\text{Engine revolutions per min.}}\right)$$

$$(KV) = \text{Ratio}\left(\frac{\text{Engine displacement per cylinder}}{\text{Air Compressor displacement}}\right)$$

(TA)=Absolute intake air temperature;

(eve)=Engine volumetric efficiency;

(AO)=Flow area of the spill orifice, 162;

(CD)=Discharge coefficient of the spill orifice, 162;

The value used for the constant, (KD), can be arbitrarily selected, with higher values of KD yielding more powerful actuator forces generated by lower values of first reference pressure, PR.

The controller, 195, compares the above calculated value of first reference pressure, PRC, for constant air fuel ratio, with the value of first reference pressure in the source, 182, and operates via the cycling valve drive means, 197, to increase the ratio of valve open time to valve closed time, when the source pressure is less than calculated pressure, and to decrease this ratio when the source pressure is greater than calculated pressure. In this way the controller, 195, functions to maintain a first reference pressure, PR, in the source, 182, equal to that value, PRC, which can maintain an essentially constant air fuel ratio over a wide range of engine speeds and loads.

A particular preferred combination for this invention comprises:

a. A gasoline fuel injector system comprising a constant mixture ratio cycler drive cam;

b. An interconnector means, as described hereinabove, suitable for use with either the pivoted lever pressure transmitter compensator, or the variable fuel orifice area compensator, whichever is used on the gasoline fuel injector system;

c. An actuator of this invention comprising the first reference pressure adjustment and control means as described hereinabove;

With this preferred combination, not only is the instantaneous air fuel ratio during each intake stroke essentially constant, but also the overall air fuel ratio remains essentially constant from one engine cycle to the next over a wide range of engine loads and speeds, and these are among the beneficial objects of this invention.

VIII. Exhaust Composition Sensor and Feedback

The actual air fuel ratio created in the engine intake manifold by the devices of this invention may nevertheless undergo changes due to various causes such as: changing to a fuel of different density; gradual gum or other deposit formation on the liquid fuel nozzle; slow wear of various components; changes of engine volumetric efficiency due to combustion chamber deposit accumulation; etc. While these changes of air fuel ratio may not greatly affect either the power or efficiency of the engine they may appreciably affect the exhaust emissions from the engine. Current engine exhaust emissions regulations require keeping the operating overall engine air fuel ratio within the narrow limits of a "low emissions window" as is well known in the art of internal combustion engines. In order to thusly keep the operating engine air fuel ratio within this low emissions window, the actuators of this invention can be modified by incorporating a feedback control from an exhaust gas composition sensor into the first reference pressure adjustment and control means.

An example exhaust gas composition sensor and feedback control scheme is shown schematically in FIG. 1 and FIG. 3 and comprises:

1. An engine exhaust gas composition sensor means, 152, for sensing the composition of the exhaust gas in the engine exhaust manifold, 10;
2. The first reference pressure adjustment and control means, 195, is modified to be additionally responsive to the exhaust gas composition sensor, 152, and to further adjust the first reference pressure so that the ratio of the fuel quantity delivered to each engine cylinder per engine intake stroke to the air quantity delivered to each engine cylinder per engine intake stroke remains within the limits of the low emissions window;
3. Currently exhaust gas oxygen content sensors are most commonly used as exhaust gas composition sensors for such feedback control purposes but other exhaust composition sensors could also be used;
4. Since the output of currently used exhaust gas composition sensors is an electrical signal, an electronic first reference pressure adjustment and control means will usually be preferred. Such electronic control and adjustment means can be similar to those currently used with conventional gasoline engine fuel injection systems.

A clearance volume adjustment and control scheme for changing the volumetric efficiency of the air compressor, 153, by changing the clearance volume thereof, and thus adjusting the pressure created in the reservoir, 156, can be used as an alternative exhaust sensor and feedback control for keeping the engine operating air fuel ratio within the low emissions window. Such a clearance volume adjustment and control scheme can additionally substitute for the above described first reference pressure adjustment and control scheme if, for example, a fixed value of first reference pressure is desired.

IX. Atomizer Means

The gasoline engine fuel injector systems, with which the actuators of this invention operate, match the instantaneous liquid flow rate to the instantaneous intake air flow rate by varying the pressure difference existing between the liquid fuel chamber and the engine intake manifold. Thus at the starting and at the ending of each engine intake stroke, when the instantaneous air flow rate is very low, this pressure difference is necessarily also correspondingly low. With such low liquid fuel pressure difference and low air flow rate the liquid fuel entering the intake manifold will be poorly atomized and hence will evaporate into the air only slowly. Such slow evaporation may cause undesirable air fuel ratio variations to be created within each air fuel mass delivered into the engine cylinder for each intake stroke. These air fuel ratio variations can be minimized by use of separate liquid fuel atomizing means such as a spinning disc atomizer or an air blast atomizer. An example air blast atomizer means is shown schematically in FIG. 1 and comprises:

1. An air blast atomizer outlet, 202, positioned to atomize the liquid fuel entering the engine intake manifold, 9, via the liquid fuel nozzle, 21.
2. The inlet, 203, to the air blast atomizer is connected to the outlet, 169, of the collector for spilled gases, 166, so that the air spilled via the spill orifice, 162, is returned to the engine intake manifold and utilized there as a liquid fuel atomizing means.

An example spinning disc atomizer means is shown schematically in FIG. 5 and comprises a spinning disc, 93, rotated at high speed by a disc drive means, 94, and positioned in the engine intake manifold, 9, so that liquid fuel, entering the intake manifold from the liquid fuel nozzle, is delivered onto the spinning disc and atomized thereby.

Air blast atomizers and spinning disc atomizers can be used alone or in combination for the purposes of this invention.

Use of Stratifier Means

It has been widely recognized for some time that substantial improvement in automobile miles per gallon of fuel can be achieved by use of small displacement, low speed, engines of consequently low engine friction power loss, combined with very high air intake supercharge to restore adequate torque output and vehicle performance. But knock and combustion violence will be greatly augmented when engine speed is low and high supercharge is being used. In consequence this scheme for improving automobile fuel efficiency is not now in use.

The use of stratified air fuel mixtures at gasoline engine intake to suppress the severity of compression ignition and knock is described in U.S. Pat. No. 4,425,892, entitled, "Further Improved Engine Intake Stratifier for Continuously Variable Stratified Mixtures," 17 Jan. 1984, and this material is incorporated herein by reference thereto.

The gasoline engine fuel injection system actuators of this invention can be readily modified to create stratified air fuel mixtures at engine intake in order to suppress the combustion violence of knock.

In the preferred forms of these mixture stratifier modifications, stratified air fuel mixtures are created only when needed as at low engine speeds with high supercharge and the low emissions, uniform, air fuel mixture is created at other engine operating conditions when knock is not taking place.

A stratified air fuel mixture can be created at engine intake whenever the ratio of instantaneous mass rate of air flow to instantaneous mass rate of fuel flow is varied about a mean value of air fuel ratio during each engine intake stroke.

With pivoted lever gasoline fuel injector systems the pivot of the pivoted lever pressure transmitter, can be oscillated back and forth through a pivot cycle by adding a cyclic stratifier drive means to the actuators of this invention. With the variable liquid fuel orifice area gasoline fuel injection systems the adjustable stop for the nozzle valve can be similarly oscillated back and forth by use of a cyclic stratifier drive means with the actuators of this invention. In these ways the instantaneous rate of fuel flow relative to the instantaneous rate of air flow can be varied about a mean value and thus a stratified air fuel mixture can be created during each intake stroke. These stratifier means can be turned on only when needed, as when combustion violence exceeds a selected amount as sensed by a combustion violence sensor, and this turning on and off of the stratifier means can be done by hand, or preferably automatically.

Figure 6:
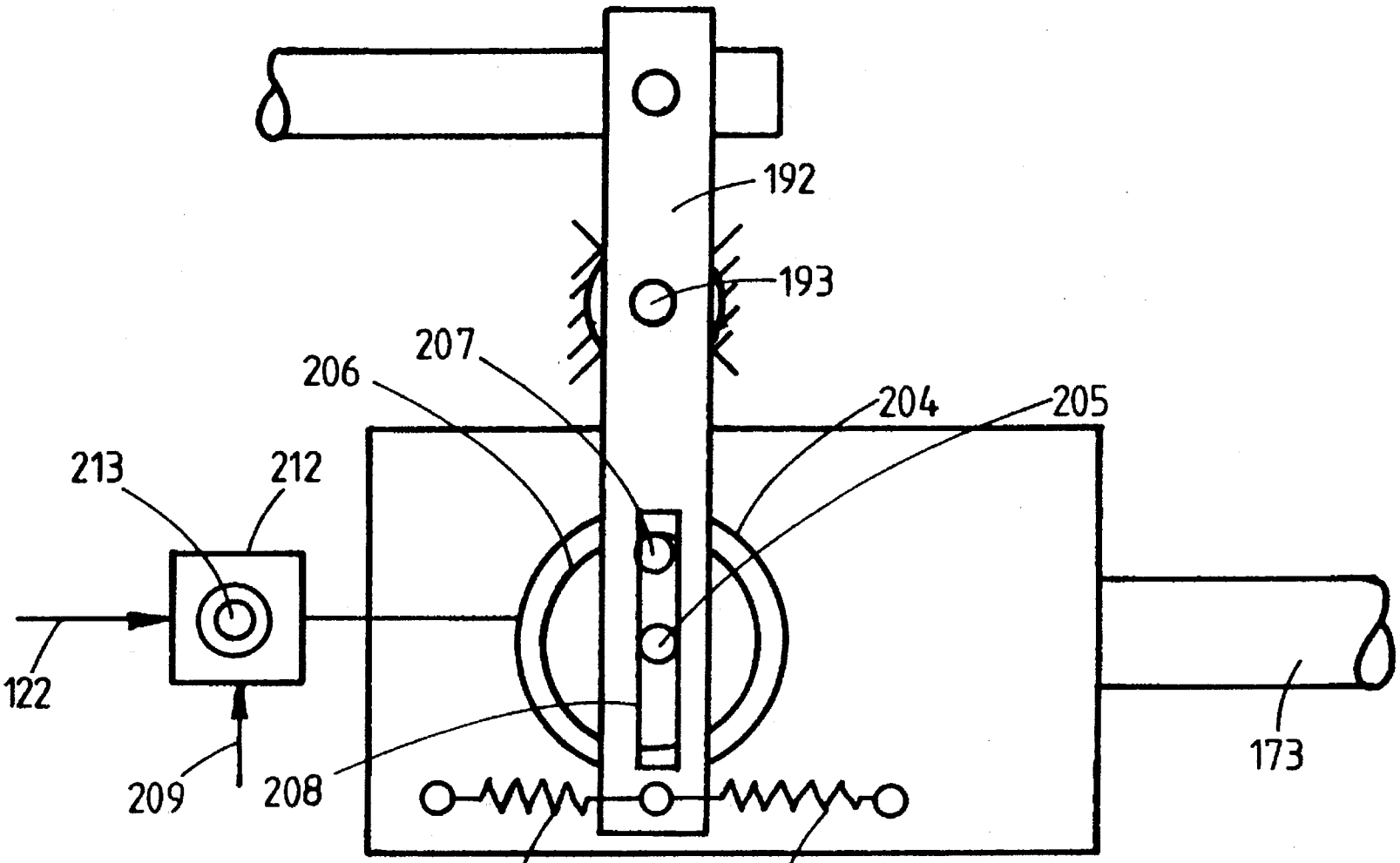
FIG. 6 shows an electric motor driven stratifier, drive means and controller.

Various types of oscillating cyclic stratifier drive means and control means can be used to move the drive end of the actuator drive bar back and forth several times during each intake stroke, when stratified air fuel mixtures are desired, such as pneumatic drive means, hydraulic drive means, electric drive means. An example electric motor driven stratifier, drive means and controller are shown schematically in FIG. 1 and FIG. 6 as added on to the drive bar, 173, and interposed between the drive bar and the interconnector means, 192, for a variable fuel orifice area compensated gasoline fuel injection system, such as that shown in FIG. 5, and comprises:

1. An electric motor, 204, whose shaft, 205, drives a pinned disc, 206, whose pin, 207, engages a slot, 208, in the interconnector means, 192.
2. When the motor, 204, is driven via the electric power source, 209, the interconnector is cyclically oscillated back and forth and thus the flow area of the liquid fuel orifice, 91, is increased and decreased about a mean value during each intake stroke when the nozzle valve, 38, is against the adjustable stop, 88. In this way a stratified air fuel mixture can be created in the intake manifold, 9.
3. The springs, 210, 211, return the interconnector, 192, to its mean position relative to the drive bar, 173, when the stratifier motor, 204, is turned off.
4. The stratifier controller, 212, responds to a combustion violence sensor, 122, such as a rate of change of pressure sensor, in the engine cylinder, 3, and operates to turn on the stratifier motor, 204, whenever the sensed level of combustion violence exceeds a preset value. This preset value can be adjusted, as by hand, via the setting means, 213, on the controller, 212.

Figure 7:
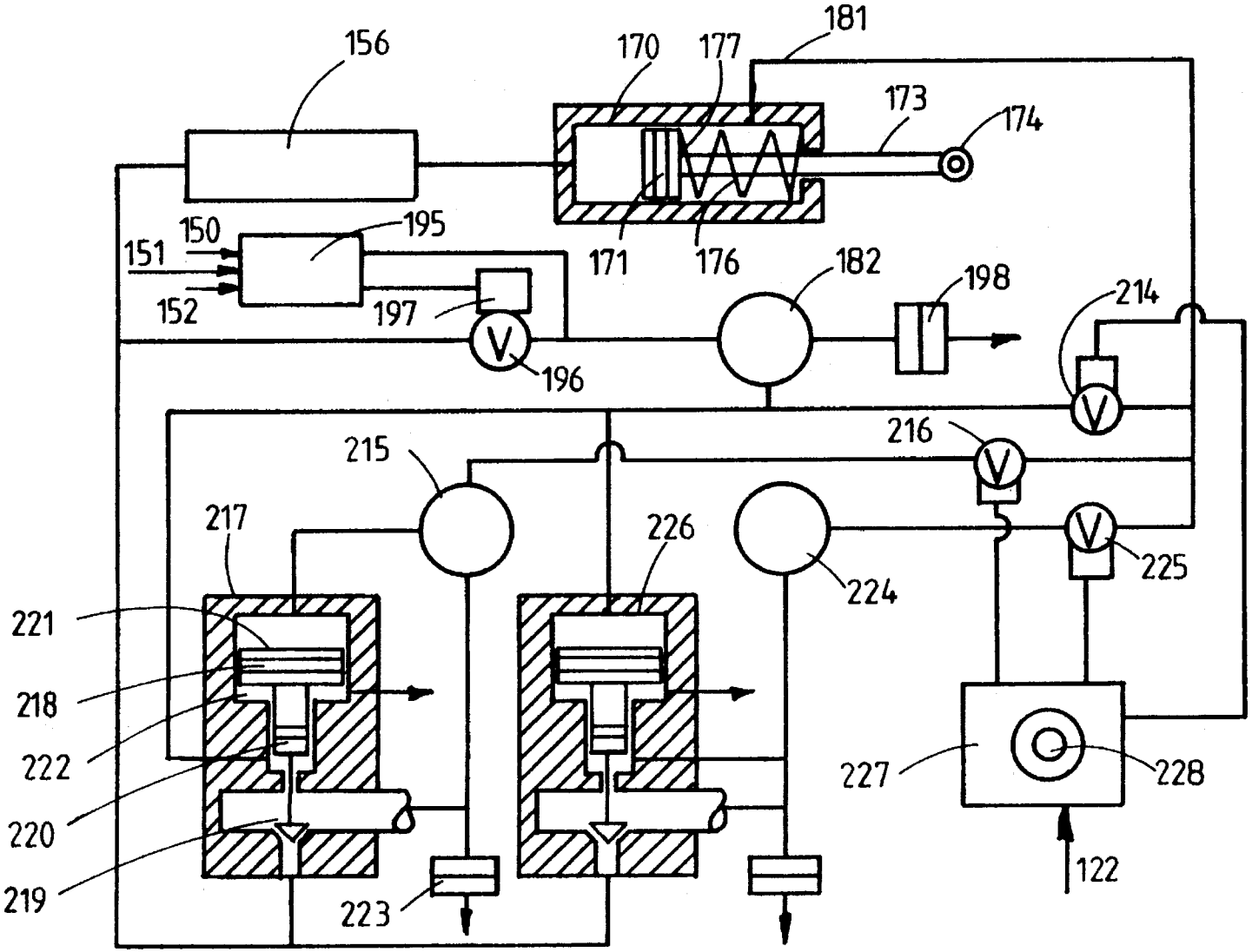
FIG. 7 shows a pneumatically driven stratifier, drive means and controller.

An example pneumatic driven stratifier drive means and controller are shown schematically in FIG. 1 and FIG. 7, suitable for use with either pivoted lever pressure transmitter or variable liquid fuel orifice area forms of gasoline fuel injector systems, and comprises:

1. The compressed gas reservoir, 156, fuel flow control actuator, 170, with piston, 171, and spring, 176, and drive bar, 173, first reference pressure source, 182, with controller, 195, and cycling valve, 196, and drive means, 197, and slow bleed orifice, 198, are similar and operate in a manner similar to that described hereinabove, except that a first on-off control valve, 214, is interposed between the first reference pressure source, 182, and the spring side, 177, connection, 181, to the actuator, 170.
2. A second low reference pressure source, 215, connects also to the spring side, 177, connection, 181, to the actuator, 170, via a second on-off and cycling control valve, 216. This second low reference pressure is set less than the first reference pressure by action of the second reference pressure regulator, 217. This regulator piston, 218, opens or closes regulator valve, 219, to admit or shut off air flow from compressed gas reservoir, 156, into second low reference pressure source, 215, via connections shown in FIG. 7. First reference pressure is applied to the small area end, 220, of the piston, 218, and second low reference pressure is applied to the large area end, 221, of the piston, 218, the interpiston volume, 222, being vented to atmosphere. Thus the second low reference pressure regulator, 217, acts to maintain a second low reference pressure in source, 215, lower than the first reference pressure in source, 182, in the ratio of the small area, 220, to the large area, 221, of the regulator piston, 218. This second low reference pressure in source, 215, can be stabilized by use of a slow bleed orifice, 223.
3. A third high reference pressure source, 224, connects also to the spring side, 177, connection, 181, to the actuator, 170, via a third on-off and cycling control valve, 225. This third high reference pressure is set higher than the first reference pressure by action of the third reference pressure regulator, 226. The third reference pressure regulator, 226 operates in the same manner as the second reference pressure regulator, 217, but sets a third reference pressure in source, 224, greater than the first reference pressure in source, 182, since first reference pressure is applied to the large area piston and third high reference pressure is applied to the small area piston.
4. The stratifier controller, 227, responds to a combustion violence sensor, 122, such as a rate of change of pressure sensor, in the engine cylinder, 3, and operates as follows:
   a. When sensed combustion violence is less than a preset value, first on-off control valve, 214, is always on and open, whereas second on-off and cycling control valve, 216, together with third on-off and cycling control valve, 225, are both off and closed. Under these conditions the actuator, 170, operates as already described hereinabove and uniform, non stratified air fuel mixture is created in the engine intake manifold.
   b. When sensed combustion violence exceeds a preset value, first on-off control valve, 214, is always off and closed, whereas second on-off and cycling control valve, 216, together with third on-off and cycling control valve, 225, are alternately opened and closed several cycles during each engine intake stroke. Under these conditions the reference pressure acting on the spring side, 177, of the actuator piston, 171, alternates between the second low reference pressure from source, 215, and the third high reference pressure from source, 224, several times during each engine intake stroke. This alternation of reference pressure causes the piston, 171, and connected drive bar, 173, to move back and forth thus creating a stratified air fuel mixture in the engine intake manifold whenever sensed combustion violence exceeds the preset value.

c. The preset value of sensed combustion violence can be adjusted, as by hand, via the setting means, 228, on the controller, 227.

What I claim is:

1. In a four stroke cycle internal combustion engine mechanism comprising: at least one piston, operative within a cylinder, and connected to a crankshaft via a connecting rod; each said piston and cylinder comprising: a variable volume chamber, between the crown of said piston and the head of said cylinder, whose volume varies when said piston is moved by said connecting rod within said cylinder by rotation of said crankshaft; an air intake valve and an exhaust valve gas flow connecting into said variable volume chamber and opened and closed by a camshaft and valve drive means from said crankshaft; said camshaft and valve drive means being timed relative to said piston so that a four stroke cycle is carried out with each two revolutions of said crankshaft; said four stroke cycle comprising in time order, an air intake stroke whenever said piston is moving to increase the volume of said variable volume chamber and said intake valve is opened and said exhaust valve is closed by said valve drive means, a compression stroke whenever said piston is moving to decrease the volume of said variable volume chamber and said intake and exhaust valves are closed by said valve drive means, an expansion stroke whenever said piston is moving to increase the volume of said variable volume chamber and said intake valve and said exhaust valve are closed by said valve drive means, a combustion process occurring during the ending of said compression stroke and the starting of said expansion stroke when fuel is supplied to said internal combustion engine mechanism, an exhaust stroke whenever said piston is moving to decrease the volume of said variable volume chamber and said exhaust valve is opened and said intake valve is closed by said valve drive means, and said four stroke cycle is repeated; an air supply intake manifold connection to said air intake valve; an exhaust gas manifold connection to said exhaust valve; a source of supply of engine liquid fuel at a pressure in excess of atmospheric; an ignition means for igniting compressed fuel air mixtures within said variable volume chamber so that a combustion process occurs during said compression and expansion strokes; an engine intake air density adjustment means for adjusting the density of the air in said air intake manifold; said four stroke cycle internal combustion engine further comprising a number of engine fuel injection systems wherein each engine cylinder is served by one such engine fuel injection system, each said engine fuel injection system comprising:

a gas pressure cycling means for cycling the pressure of a gas quantity so that during each cycle said gas pressure rises from a starting pressure to a peak pressure and said pressure rise is followed by a pressure decrease from said peak pressure to essentially said starting pressure; said gas pressure cycling means comprising, a variable volume chamber, containing said gas quantity, enclosed between a fixed container and a moveable element operating sealably within said fixed container, pressure cycler means for driving said moveable element so that said variable volume is decreased to increase the pressure of said gas quantity and is subsequently increased to decrease the pressure of said gas quantity and to thusly cycle the pressure of said gas quantity, first means for connecting said variable volume chamber to said engine air supply intake manifold only during the ending of said pressure decrease and the start of the next said pressure increase so that said starting pressure essentially equals the pressure in said engine air supply intake manifold;.

fuel injector means for injecting liquid fuel into said engine air supply intake manifold during each said air intake stroke and comprising: a fuel injector nozzle, a liquid fuel chamber containing liquid fuel, a nozzle valve means for connecting and disconnecting said fuel injector nozzle to said liquid fuel chamber and comprising drive means for opening and closing said nozzle valve means, a fuel supply valve means for connecting and disconnecting said liquid fuel chamber to said engine fuel supply source and comprising drive means for opening and closing said fuel supply valve means, a liquid fuel pressurizer means for applying pressure to said liquid fuel in said liquid fuel chamber;

said fuel injector nozzle of said fuel injector means connecting into said engine air supply intake manifold;

pressure transmitter means for transmitting pressure from said variable volume chamber of said gas pressure cycling means to said liquid fuel pressurizer means of said fuel injector means so that pressure increase in said variable volume chamber of said gas pressure cycling means is transmitted as pressure increase on said liquid fuel in said liquid fuel chamber, and so that pressure decrease in said variable volume chamber is transmitted as pressure decrease on said liquid fuel, and so that gas does not enter said liquid fuel chamber and so that liquid fuel does not enter said variable volume chamber of said gas pressure cycling means, said pressure transmitter means comprising: means for connecting and disconnecting said pressure transmitter to said variable volume chamber of said gas pressure cycling means so that pressure increase and decrease in said variable volume chamber act upon said pressure transmitter only during and throughout each said air intake stroke; and so that the pressure acting upon said liquid fuel in said liquid fuel chamber via said pressure transmitter is less than said liquid fuel supply pressure during and throughout each said compression stroke, expansion stroke and exhaust stroke;

inter drive means for driving said moveable element of said gas pressure cycling means from said crankshaft of said internal combustion engine mechanism so that, a pressure cycle takes place during each said air intake stroke, and so that the duration of said pressure cycle is essentially equal to the duration of said intake stroke;

intake stroke sensor means for sensing the start of said air intake stroke and the end of said air intake stroke of said internal combustion engine mechanism;

fuel valve control means for controlling the connecting and disconnecting of said fuel injector nozzle to said liquid fuel chamber and for controlling the connecting and disconnecting of said liquid fuel chamber to said engine fuel supply source, and responsive to said intake stroke sensor means, and operative upon said nozzle valve means drive means and said fuel supply valve drive means, so that said nozzle valve means connects said fuel injector nozzle to said liquid fuel chamber only from the start to the end of each said air intake stroke, and so that said fuel supply valve means connects said liquid fuel chamber to said engine fuel supply source only when said nozzle valve means has disconnected said fuel injector nozzle from said liquid fuel chamber:

fuel flow control means for controlling the fuel quantity delivered into each said engine intake manifold, and thence into each connected engine cylinder, per engine intake stroke by adjustment of the integrated product of fuel flow area of said fuel injector nozzle multiplied by the square root of the pressure difference between said liquid fuel chamber and said engine intake manifold, said product integrated over the time duration of one engine intake stroke.

wherein the improvement comprises adding an engine fuel injector system actuator to each said fuel injector system, said actuator comprising:

a source of gas to be compressed;

a positive and fixed displacement gas compressor means for compressing gases and comprising a gas inlet and a compressed gas outlet;

a drive means for driving said gas compressor means so that the rotational speed of said gas compressor is a fixed multiple of the rotational speed of said engine crankshaft;

a compressed gas reservoir comprising a reservoir inlet and at least two reservoir outlets;

a compressed gas spill orifice comprising an orifice inlet and an orifice outlet;

a collector for spilled gases comprising a collector inlet and a collector outlet;

said gas inlet of said gas compressor means being connected to said source of gas to be compressed;

said compressed gas outlet of said gas compressor means being connected to said reservoir inlet of said compressed gas reservoir;

said compressed gas spill orifice inlet being connected to one of said reservoir outlets of said compressed gas reservoir;

said compressed gas spill orifice outlet being connected to said collector inlet of said collector for spilled gases;

said collector outlet of said collector for spilled gases being connected to the engine intake manifold;

wherein said source of gas to be compressed is the engine intake manifold downstream in the intake air flow direction of said means for adjusting intake manifold air density;

at least one source of gas at a first reference pressure, said first reference pressure being less than the pressure in said compressed gas reservoir and greater than the pressure in said engine intake manifold downstream of said means for adjusting intake manifold air density;

a fuel flow control actuator means for controlling the fuel flow per engine intake stroke delivered to each engine cylinder by said engine fuel injection system of said internal combustion engine, said fuel flow control actuator means comprising: a piston sealably operative within a fixed actuator cylinder and connected to a fuel flow control drive bar, said drive bar comprising a drive end opposite the piston end thereof; a compression spring within said cylinder acting upon one side of said piston; both ends of said cylinder having pressure connections, a spring side pressure connection to that cylinder end containing the spring, an anti spring side pressure connection to that other cylinder end, both cylinder ends being otherwise gas sealed;

said anti spring side pressure connection of said fuel flow control actuator means being connected to one other of said reservoir outlets of said compressed gas reservoir;

said spring side pressure connection of said fuel flow control actuator means being connected to said source of gas at a first reference pressure;

said fuel flow control actuator means further comprising interconnector means for connecting said fuel flow control drive bar drive end to said fuel flow control means for controlling the fuel quantity delivered to each engine cylinder per engine intake stroke of each said engine fuel injection system, so that the fuel quantity delivered to each engine cylinder per engine intake stroke increases as the air quantity delivered to each engine cylinder per engine intake stroke increases, and decreases as said air quantity decreases.

2. In a four stroke cycle internal combustion engine mechanism as described in claim 1 wherein said at least one source of gas at a first reference pressure is the atmosphere.

3. In a four stroke cycle internal combustion engine mechanism as described in claim 1 and further comprising:

intake manifold pressure sensor means for sensing the absolute pressure in the engine intake manifold downstream in the intake air flow direction of said means for adjusting intake manifold air density;

compressed gas pressure sensor means for sensing the absolute pressure in said compressed gas reservoir;

first reference pressure adjustment means for adjusting and controlling said first reference pressure and responsive to said engine intake manifold pressure sensor, and responsive to said compressed gas reservoir pressure sensor, and operative to adjust said first reference pressure so that; the distance of the drive end of said fuel flow control drive bar of said fuel flow control actuator means from said fixed actuator cylinder of said fuel flow control actuator means varies linearly with the product of air mass quantity delivered to each engine cylinder per engine intake stroke times the engine crankshaft revolutions per unit of time divided by the square root of the absolute engine intake manifold pressure downstream in the intake air flow direction of said means for adjusting intake manifold air density;

wherein said interconnector means of said fuel flow control actuator means connects said fuel flow control drive bar drive end to said fuel flow control means for controlling the fuel quantity delivered to each engine cylinder per engine intake stroke of each said engine fuel injection system so that the ratio of the fuel quantity delivered to each engine cylinder per engine intake stroke to the air quantity delivered to each engine cylinder per engine intake stroke is essentially constant.

4. In a four stroke cycle internal combustion engine mechanism as described in claim 3 and further comprising:

exhaust composition sensor means for sensing the composition of the engine exhaust gas in said engine exhaust manifold;

wherein said reference pressure adjustment means for adjusting and controlling said first reference pressure is additionally responsive to said exhaust composition sensor means so that the ratio of the fuel quantity delivered to each engine cylinder per engine intake stroke to the air quantity delivered to each engine cylinder per engine intake stroke remains within the limits of the low emissions window.

5. In a four stroke cycle internal combustion engine mechanism as described in claim 1 and further comprising:

air blast atomizer means for atomizing a liquid fuel and comprising an air inlet and an air outlet, said air outlet being positioned to atomize liquid fuel entering said engine intake manifold from said engine fuel injector system, said air inlet being connected to said collector outlet of said collector for spilled gases.

6. In a four stroke cycle internal combustion engine mechanism as described in claim 1 and further comprising:

stratifier means for stratifying the air fuel mixture created in said engine intake manifold, by varying the flow rate of liquid fuel into said engine intake manifold during each said engine air intake stroke, and comprising cyclic drive means for cyclically varying the distance between the drive end of said fuel flow control drive bar and said fixed actuator cylinder of said fuel flow control actuator means through several cycles of variation during each said engine air intake stroke;

combustion violence sensor means for sensing the time rate of pressure increase during combustion in said variable volume chamber of said internal combustion engine;

stratifier control means for controlling said cyclic drive means of said stratifier means and responsive to said combustion violence sensor means and operative upon said cyclic drive means so that said cyclic drive means is operative only when said sensed time rate of pressure increase in said variable volume chamber exceeds a preset value.

7. In a four stroke cycle internal combustion engine mechanism as described in claim 3 and further comprising:

stratifier means for stratifying the air fuel mixture created in said engine intake manifold, by varying the flow rate of liquid fuel into said engine intake manifold during each said engine air intake stroke, and comprising cyclic drive means for cyclically varying the distance between the drive end of said fuel flow control drive bar and said fixed actuator cylinder of said fuel flow control actuator means through several cycles of variation during each said engine air intake stroke;

combustion violence sensor means for sensing the time rate of pressure increase during combustion in said variable volume chamber of said internal combustion engine;

stratifier control means for controlling said cyclic drive means of said stratifier means and responsive to said combustion violence sensor means and operative upon said cyclic drive means so that said cyclic drive means is operative only when said sensed time rate of pressure increase in said variable volume chamber exceeds a preset value.

* * * * *